US009213347B2

(12) United States Patent
Kim et al.

(10) Patent No.: US 9,213,347 B2
(45) Date of Patent: Dec. 15, 2015

(54) LOW-DROPOUT REGULATOR, POWER MANAGEMENT SYSTEM, AND METHOD OF CONTROLLING LOW-DROPOUT VOLTAGE

(71) Applicants: Je-Kook Kim, Yongin-Si (KR); Sang-Yong Park, Anyang-Si (KR); Chan-Woo Park, Anyang-Si (KR); Young-Hoon Lee, Seoul (KR); Byeong-Ha Park, Seongnam-Si (KR)

(72) Inventors: Je-Kook Kim, Yongin-Si (KR); Sang-Yong Park, Anyang-Si (KR); Chan-Woo Park, Anyang-Si (KR); Young-Hoon Lee, Seoul (KR); Byeong-Ha Park, Seongnam-Si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 14/556,110

(22) Filed: Nov. 29, 2014

(65) Prior Publication Data

US 2015/0177758 A1 Jun. 25, 2015

(30) Foreign Application Priority Data

Dec. 23, 2013 (KR) ..... 10-2013-0161613

(51) Int. Cl.
*G05F 1/575* (2006.01)

(52) U.S. Cl.
CPC ..... *G05F 1/575* (2013.01)

(58) Field of Classification Search
CPC ..... G05F 1/56; G05F 1/575; G05F 3/30; G05F 3/247; G05F 3/263; H02M 3/156; H02M 3/1588
USPC ..... 323/273, 280, 282, 313, 314, 316
See application file for complete search history.

(56) References Cited

U.S. PATENT DOCUMENTS

| | | | | |
|---|---|---|---|---|
| 5,262,779 | A | 11/1993 | Sauer | |
| 5,604,465 | A | 2/1997 | Farabaugh | |
| 6,160,449 | A | 12/2000 | Klomsdorf et al. | |
| 6,275,685 | B1 | 8/2001 | Wessel et al. | |
| 6,874,097 | B1 | 3/2005 | Aliahmad et al. | |
| 7,034,599 | B1 | 4/2006 | Agrawal et al. | |
| 7,148,749 | B2 | 12/2006 | Rahman et al. | |
| 7,170,269 | B1 * | 1/2007 | Doyle | 323/280 |

(Continued)

FOREIGN PATENT DOCUMENTS

| | | |
|---|---|---|
| JP | 2011066894 | 3/2011 |
| KR | 1020010095928 | 11/2001 |

(Continued)

OTHER PUBLICATIONS

Yasuyuki Okuma et al., "0.5-V Input Digital LDO with 98.7% Current Efficiency and 2.7-MA Quiescent Current in 65nm CMOS," 2010 IEEE.

*Primary Examiner* — Adolf Berhane
(74) *Attorney, Agent, or Firm* — Volentine & Whitt, PLLC

(57) ABSTRACT

A low-dropout regulator comprises an analog-to-digital converter that converts a feedback analog voltage signal into a digital signal, a phase synthesizing unit that generates a first control signal having a pulse width corresponding to error information in the digital signal by performing phase synthesis according to clock skew control, a charge pump circuit that selects a charge loop or a discharge loop based on polarity information in the digital signal, and generates an output control voltage according to current that flows during a period corresponding to the pulse width of the first control signal in the selected loop, and an output circuit that generates an output voltage based on an input voltage and the output control voltage, and generates the feedback analog voltage signal based on the output voltage.

19 Claims, 22 Drawing Sheets

(56) References Cited

U.S. PATENT DOCUMENTS

| | | | | |
|---|---|---|---|---|
| 7,443,326 | B2 | 10/2008 | Raphaeli | |
| 7,486,058 | B2 | 2/2009 | Szepesi | |
| 7,495,422 | B2 * | 2/2009 | Mok et al. | 323/280 |
| 7,594,127 | B2 | 9/2009 | Sutardja | |
| 7,706,160 | B2 | 4/2010 | Fontana et al. | |
| 7,728,644 | B2 | 6/2010 | Seo et al. | |
| 7,872,454 | B2 * | 1/2011 | Sutardja | 323/222 |
| 7,940,202 | B1 | 5/2011 | Kutz et al. | |
| 8,022,681 | B2 | 9/2011 | Gurcan | |
| 8,134,486 | B2 | 3/2012 | Lai et al. | |
| 2,248,282 | A1 | 8/2012 | Payne et al. | |
| 8,248,150 | B2 | 8/2012 | Tadeparthy et al. | |
| 8,248,282 | B2 | 8/2012 | Payne et al. | |
| 8,299,763 | B2 | 10/2012 | Sutardja | |
| 8,400,126 | B2 * | 3/2013 | Iacob et al. | 323/282 |
| 8,472,556 | B2 | 6/2013 | Shi et al. | |
| 8,872,492 | B2 * | 10/2014 | Zhang et al. | 323/280 |
| 9,018,924 | B2 * | 4/2015 | Vemula | 323/281 |
| 9,054,726 | B2 * | 6/2015 | Okuda et al. | 1/1 |
| 2001/0046272 | A1 * | 11/2001 | Miyano | 375/375 |
| 2002/0091496 | A1 | 7/2002 | Cheng et al. | |
| 2005/0007203 | A1 * | 1/2005 | Chen | 331/45 |
| 2007/0247124 | A1 | 10/2007 | Mihashi | |
| 2011/0090940 | A1 | 4/2011 | Wadhwa et al. | |
| 2011/0121800 | A1 | 5/2011 | Drebinger | |
| 2012/0187927 | A1 | 7/2012 | Yu et al. | |
| 2012/0229202 | A1 | 9/2012 | Nikolov et al. | |
| 2012/0230158 | A1 | 9/2012 | Chuang et al. | |

FOREIGN PATENT DOCUMENTS

| | | | |
|---|---|---|---|
| KR | 1020080067466 | A | 7/2008 |
| KR | 100904425 | | 6/2009 |
| KR | 101298375 | | 8/2013 |

* cited by examiner

LOW-DROPOUT REGULATOR, POWER MANAGEMENT SYSTEM, AND METHOD OF CONTROLLING LOW-DROPOUT VOLTAGE

CROSS-REFERENCE TO RELATED APPLICATION

This application claims priority under 35 USC 119 to Korean Patent Application No. 10-2013-0161613, filed on Dec. 23, 2013, the subject matter of which is hereby incorporated by reference.

BACKGROUND OF THE INVENTION

The inventive concept relates generally to controlling an output voltage of a voltage source, and more particularly to a low-dropout (LDO) regulator, a power management system, and a method of controlling an LDO voltage to regulate an output voltage under digital control.

An LDO regulator is a voltage regulator that is used under conditions where a difference between an input voltage and an output voltage is low. An LDO regulator is typically designed as an analog circuit, which means that it may be relatively large and subject to imprecision. Accordingly, there is a general need for LDO regulators having reduced size and improved precision.

SUMMARY OF THE INVENTION

In one embodiment of the inventive concept, an LDO regulator comprises an analog-to-digital converter (ADC) that converts a feedback analog voltage signal into a first digital signal, and generates a second digital signal corresponding to a difference between the first digital signal and a target digital signal, a phase synthesizing unit that generates a first control signal having a pulse width corresponding to error information in the second digital signal by performing phase synthesis on signals generated according to a skew delay within a clock cycle and a delay by one clock cycle based on the second digital signal, a charge pump circuit that selects a charge loop or a discharge loop based on polarity information in the second digital signal, and generates an output control voltage according to current that flows during a period corresponding to the pulse width of the first control signal in the selected loop, and an output circuit that generates an output voltage according to a switching operation performed on an input voltage based on the output control voltage, and generates the feedback analog voltage signal from the output voltage.

A power management system comprises a multiplexer that multiplexes feedback analog voltage signals for multiple LDO regulators based on time division, an ADC that converts a signal output from the multiplexer into multiple first digital signals, a demultiplexer that distributes the first digital signals to multiple channels based on time division, digital error signal generating units corresponding to the channels and each generating a second digital signal corresponding to a difference between one of the first digital signals and a target digital signal in a corresponding one of the channels, and digitally controlled LDO apparatuses corresponding to the channels and each generating an analog output voltage and a feedback analog voltage signal by performing phase synthesis on signals that are generated according to a skew delay within a clock cycle and a delay by one clock cycle based on one of the second digital signals that is input through a corresponding one of the channels.

In another embodiment of the inventive concept, a method of controlling a an LDO voltage comprises converting a feedback analog voltage signal into a first digital signal using an ADC of an LDO regulator, generating a second digital signal corresponding to a difference between the first digital signal and a target digital signal, generating a charge pump control signal by performing phase synthesis on signals generated according to skew control within a clock cycle and delay control by one clock cycle based on the second digital signal, generating an output control voltage by adjusting a charge or discharge time in a charge pump circuit based on the charge pump control signal, and generating an output voltage according to a switching operation performed on an input voltage based on the output control voltage. The feedback analog voltage signal is generated based on the output voltage.

In another embodiment of the inventive concept, an LDO regulator comprises an ADC that converts a feedback analog voltage signal into a digital signal, a phase synthesizing unit that generates a first control signal having a pulse width corresponding to error information in the digital signal by performing phase synthesis according to clock skew control, a charge pump circuit that selects a charge loop or a discharge loop based on polarity information in the digital signal, and generates an output control voltage according to current that flows during a period corresponding to the pulse width of the first control signal in the selected loop, and an output circuit that generates an output voltage based on an input voltage and the output control voltage, and generates the feedback analog voltage signal based on the output voltage.

These and other embodiments of the inventive concept may allow an LDO regulator to operate with high resolution without increasing a clock frequency. They may also provide other potential benefits such as reduced chip size and compensation for variations in process characteristics.

BRIEF DESCRIPTION OF THE DRAWINGS

The drawings illustrate selected embodiments of the inventive concept. In the drawings, like reference labels indicate like features.

DETAILED DESCRIPTION

Figure 1A:
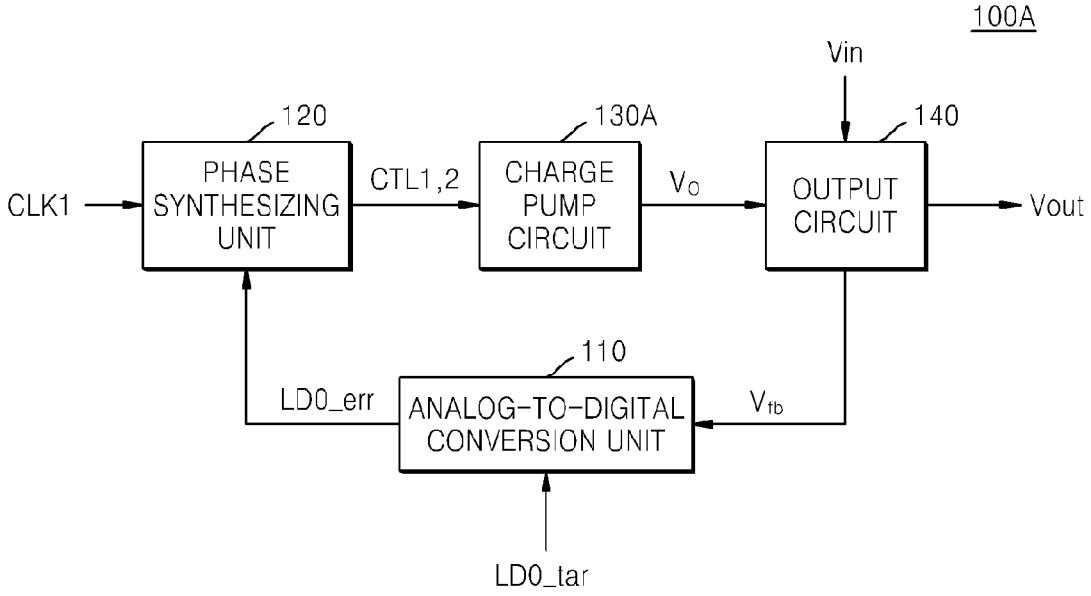
FIG. 1A is a block diagram illustrating an LDO regulator, according to an embodiment of the inventive concept.

Embodiments of the inventive concept are described below with reference to the accompanying drawings. These embodiments are presented as teaching examples and should not be construed to limit the scope of the inventive concept.

The terminology used herein is for the purpose of describing particular embodiments only and is not intended to be limiting of embodiments of the inventive concept. As used herein, terms in singular form, e.g., "a", "an" and "the", are intended to include the plural forms as well, unless the context clearly indicates otherwise. Terms such as "comprises", "comprising,", "includes", "including", etc., where used herein, indicate the presence of stated features but do not preclude the presence or addition of one or more other features.

Unless otherwise defined, all terms (including technical and scientific terms) used herein have the same meaning as commonly understood by one of ordinary skill in the art. Terms such as those defined in commonly used dictionaries should be interpreted as having a meaning that is consistent with their meaning in the context of the relevant art and should not be interpreted in an idealized or overly formal sense unless expressly so defined herein.

In certain embodiments described below, an LDO regulator comprises a digital-to-analog converter (DAC) that converts a digital signal into an analog signal by charging or discharging an internal capacitor using a constant current source of a charge pump circuit based on a digital signal obtained through analog-to-digital conversion.

A voltage V of the internal capacitor is defined by the following equation (1).

$$dV/dt=i/C \quad (1)$$

In equation (1), "i" denotes current that flows in the internal capacitor, "t" denotes time, and "C" denotes a capacitance of the internal capacitor.

According to equation (1), voltage V may be changed according to time t in a state where capacitance C and the current i are fixed. For example, assuming that a frequency of a system clock signal used in a system is 2 MHz, where the time t is to be expressed with 16 bits, time control must be done using 32 GHz. Theoretically, where a clock signal having a frequency of 32 GHz is newly formed and used, the time t may be expressed with 16 bits. However, a significant amount of noise may be generated in a clock signal at 32 GHz, which may adversely affect the system and make it difficult to precisely generate the clock signal.

The described embodiments may provide increased resolution without increasing a frequency of a clock signal by using an ADC during output voltage control in an LDO regulator. For example, certain embodiments provide a method for increasing a resolution of an LDO regulator using phase synthesis according to clock skew control. Certain embodiments also provide a method that is not affected by a change in process characteristics and in a voltage by using normalized phase skew control through calibration to compensate for a change in process characteristics in a phase skew chain path.

FIG. 1A is a block diagram illustrating an LDO regulator 100A, according to an embodiment of the inventive concept.

Referring to FIG. 1A, LDO regulator 100A comprises an ADC 110, a phase synthesizing unit 120, a charge pump circuit 130A, and an output circuit 140.

A feedback analog voltage signal $V_{fb}$ generated in output circuit 140 is input to ADC 110. ADC 110 converts the input feedback analog voltage signal $V_{fb}$ into a first digital signal, and it generates a second digital signal LDO_err corresponding to a difference between the first digital signal and a target digital signal LDO_tar.

For example, second digital signal LDO_err may comprise one or more bits comprising polarity information, and one or more bits comprising error information. The polarity information may comprise a most significant bit of second digital signal LDO_err and the error information may comprise bits other than the most significant bit.

Phase synthesizing unit 120 generates a second control signal CTL2 having a logic state corresponding to the polarity information in second digital signal LDO_err, and generates a first control signal CTL1 having a pulse width corresponding to the error information in second digital signal LDO_err. For example, an output of the most significant bit indicating the polarity information of second digital signal LDO_err may be second control signal CTL2.

Phase synthesizing unit 120 generates first control signal CTL1 having the pulse width corresponding to the error information by synthesizing phases of signals that are generated according to skew control within a clock cycle and delay control by one clock cycle based on the error information in second digital signal LDO_err.

Charge pump circuit 130A selectively forms a charge loop or a discharge loop for charging or discharging an internal capacitor based on the logic state of second control signal CTL2, and it makes current flow during a period corresponding to the pulse width of first control signal CTL1 in the selected loop. Due to this operation, an output control voltage $V_O$ whose level is regulated by second digital signal LDO_err is generated in charge pump circuit 130A.

Output circuit 140 generates an output voltage Vout according to a switching operation performed on an input voltage Vin based on output control voltage $V_O$ that is applied from charge pump circuit 130A, and it generates feedback analog voltage signal $V_{fb}$ from output voltage Vout.

Output circuit 140 typically comprises a transistor that turns on or off electrical connection between a first terminal and a second terminal to which input voltage Vin is applied based on output control voltage Vo that is applied to a gate terminal, a voltage divider circuit that is connected between the first terminal and a ground terminal and generates feedback analog voltage signal $V_{fb}$, and a capacitor that is disposed between the first terminal and the ground terminal and is connected in parallel to the voltage divider circuit. Output circuit 140 may generate output voltage Vout at the first terminal.

Figure 1B:
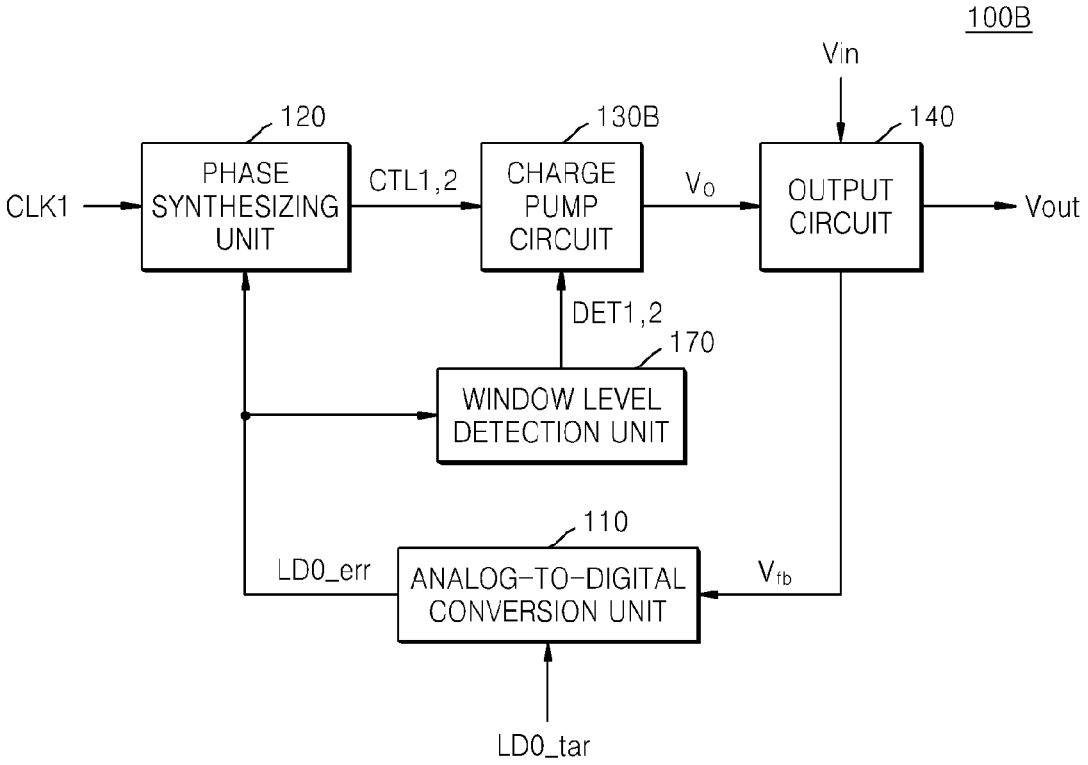
FIG. 1B is a block diagram illustrating an LDO regulator, according to another embodiment of the inventive concept.

FIG. 1B is a block diagram illustrating an LDO regulator 100B, according to another embodiment of the inventive concept.

Referring to FIG. 1B, LDO regulator 100B comprises ADC 110, phase synthesizing unit 120, a charge pump circuit 130B, output circuit 140, and a window level detection unit 170.

As described with reference to FIG. 1A, ADC 110 outputs second digital signal LDO_err, and phase synthesizing unit 120 outputs first control signal CTL1 having the pulse width corresponding to the error information in second digital signal LDO_err and second control signal CTL2 having the logic state corresponding to the polarity information in second digital signal LDO_err.

Window level detection unit 170 determines whether second digital signal LDO_err exists within a window level range, and it generates first and second detection signals DET1 and DET2. For example, the window level range is a preset value for detecting whether output voltage Vout of LDO regulator 100B exceeds a predetermined range from a target voltage.

Window level detection unit 170 generates first detection signal DET1 having a first logic state during a period where an error value in second digital signal LDO_err is less than a lower threshold value of a window level, and it generates second detection signal DET2 having a first logic state during a period where the error value is greater than an upper threshold value of the window level. Where the error value in second digital signal LDO_err exists within the window level range, each of first detection signal DET1 and second detection signal DET2 has a second logic state. For example, the first logic state may be set to '1', and the second logic state may be set to '0'.

A magnitude of the error value may be determined by the error information in second digital signal LDO_err, and a sign of the error value may be determined by the polarity information in second digital signal LDO_err.

Charge pump circuit 130B selectively forms a charge loop or a discharge loop for charging or discharging an internal capacitor based on the logic state of second control signal CTL2, and makes current flow during a period corresponding to the pulse width of first control signal CTL1 in the selected loop.

Also, charge pump circuit 130B forms an additional sub-charge loop based on first detection signal DET1, and it forms an additional sub-discharge loop based on second detection signal DET2. For example, where first detection signal DET1 having a first logic state is applied during a period other than a period where charge current or discharge current flows due to first control signal CTL1, additional charge current flows in charge pump circuit 130B. Likewise, where second detection signal DET2 having a first logic state is applied during a period other than a period where charge current or discharge current flows due to first control signal CTL1, additional discharge current flows in charge pump circuit 130B.

Due to this operation, where output voltage Vout exceeds a predetermined range from a target voltage, charge pump circuit 130B generates output control voltage Vo due to first and second control signals CTL1 and CTL2 and first and second detection signals DET1 and DET2 so that output voltage Vout rapidly follows the target voltage.

Output circuit 140 generates output voltage Vout according to a switching operation performed on input voltage Vin based on output control voltage Vo that is applied from charge pump circuit 130B, and generates feedback analog voltage signal $V_{fb}$ from output voltage Vout.

Figure 1C:
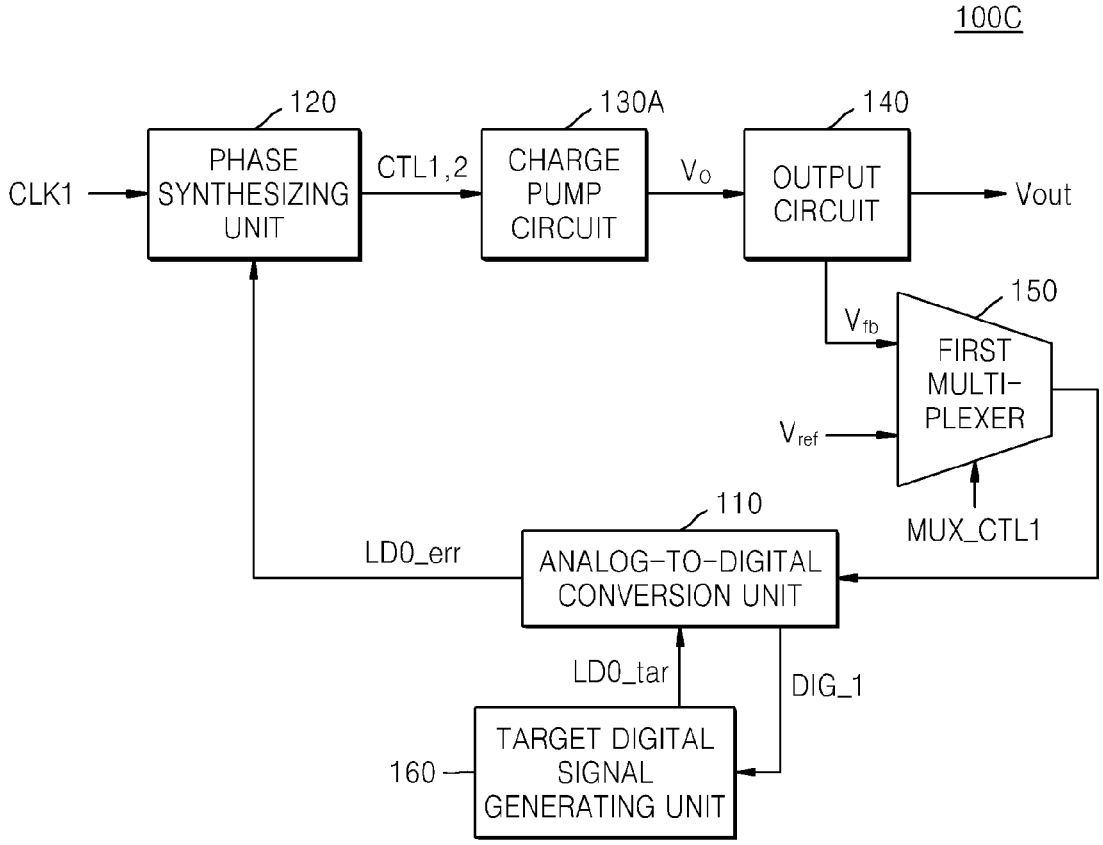
FIG. 1C is a block diagram illustrating an LDO regulator, according to another embodiment of the inventive concept.

FIG. 1C is a block diagram illustrating an LDO regulator 100C, according to another embodiment of the inventive concept.

Referring to FIG. 1C, LDO regulator 100C comprises ADC 110, phase synthesizing unit 120, charge pump circuit 130A, output circuit 140, a first multiplexer 150, and a target digital signal generating unit 160.

First multiplexer 150 receives a constant voltage signal $V_{ref}$ and feedback analog voltage signal $V_{fb}$ output from output circuit 140, and it selects one of feedback analog voltage signal $V_{fb}$ and constant voltage signal $V_{ref}$ according to a first selection control signal MUX_CTL1 and outputs the selected signal to ADC 110. Constant voltage signal $V_{ref}$ may be, for example, a constant voltage output from a band-gap reference voltage generating circuit.

First multiplexer 150 selects and outputs constant voltage signal $V_{ref}$ according to first selection control signal MUX_CTL1 in a mode for setting target digital signal LDO_tar. In other modes, first multiplexer 150 selects and outputs feedback analog voltage signal $V_{fb}$ according to first selection control signal MUX_CTL1. For example, the mode for setting target digital signal LDO_tar may be performed where LDO regulator 100C is initialized.

In the mode for setting target digital signal LDO_tar, constant voltage signal $V_{ref}$ is input to ADC 110. ADC 110 converts input constant voltage signal $V_{ref}$ into a first digital signal DIG_1 and outputs first digital signal DIG_1 to target digital signal generating unit 160.

Target digital signal generating unit 160 generates target digital signal LDO_tar based on first digital signal DIG_1 that is input from ADC 110 in the mode for setting target digital signal LDO_tar. Target digital signal LDO_tar may be determined by multiplying a result obtained by performing an averaging operation on first digital signal DIG_1 by a gain value that is initially set. For example, where constant voltage signal $V_{ref}$ is 2 V and LDO regulator 100C is designed to produce 4 V, the gain value may be set to 2. Alternatively, where constant voltage signal $V_{ref}$ is 4 V and LDO regulator 100C is designed to produce 2 V, the gain value may be set to 0.5.

In any of modes other than the mode for setting target digital signal LDO_tar, feedback analog voltage signal $V_{fb}$ is input to ADC 110. ADC 110 converts the input feedback analog voltage signal $V_{fb}$ into first digital signal DIG_1, and generates second digital signal LDO_err corresponding to a difference between first digital signal DIG_1 and target digital signal LDO_tar.

Operations of phase synthesizing unit 120, charge pump circuit 130A, and output circuit 140 of FIG. 1C are the same as those of FIG. 1A, and thus an explanation thereof will not be repeated here.

Figure 1D:
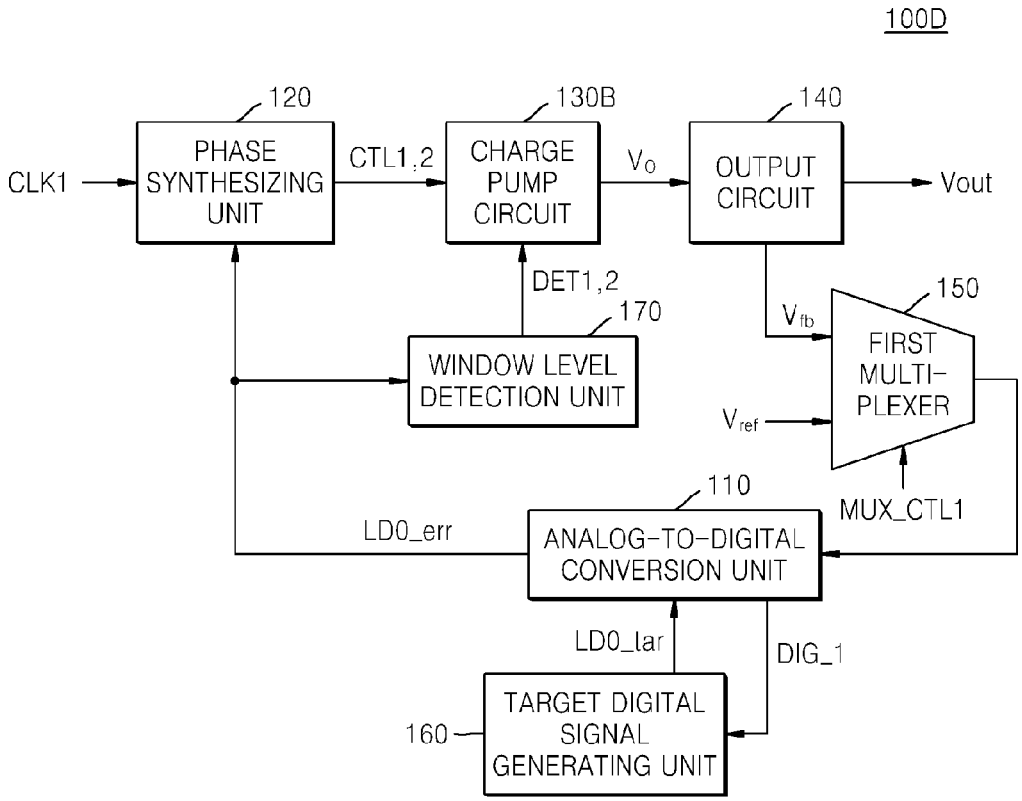
FIG. 1D is a block diagram illustrating an LDO regulator, according to another embodiment of the inventive concept.

FIG. 1D is a block diagram illustrating an LDO regulator 100D, according to another embodiment of the inventive concept.

Referring to FIG. 1D, LDO regulator 100D comprises ADC 110, phase synthesizing unit 120, charge pump circuit 130B, output circuit 140, first multiplexer 150, target digital signal generating unit 160, and window level detection unit 170.

Operations of ADC 110, first multiplexer 150, and target digital signal generating unit 160 of FIG. 1D are the same as those of FIG. 1C and operations of phase synthesizing unit 120, charge pump circuit 130B, output circuit 140, and window level detection unit 170 are the same as those of FIG. 1B, and thus an explanation thereof will not be repeated here.

Figure 2:
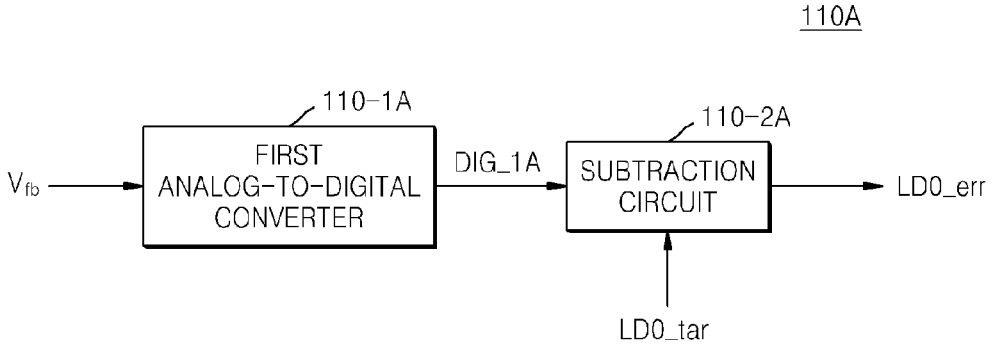
FIG. 2 is a block diagram illustrating a detailed structure of an analog-to-digital converter (ADC) of FIGS. 1A through 1D, according to an embodiment of the inventive concept.

FIG. 2 is a block diagram illustrating a detailed structure of an ADC 110A of FIGS. 1A through 1D, according to an embodiment of the inventive concept.

Referring to FIG. 2, ADC 110A comprises a first ADC 110-1A and a subtraction circuit 110-2A.

First ADC 110-1A converts feedback analog voltage signal $V_{fb}$ that is input from output circuit 104 into a 1A digital signal DIG_1A of N (N>1) bits. A level of resolution of any of LDO regulators 100A through 100D is determined by the number N of bits of the 1A digital signal DIG_1A.

Subtraction circuit 110-2A receives the 1A digital signal DIG_1A of N bits output from first ADC 110-1A. Subtraction circuit 110-2A generates second digital signal LDO_err of N bits corresponding to a difference between the 1A digital signal DIG_1A of N bits and target digital signal LDO_tar of N bits. For example, subtraction circuit 110-2A may generate second digital signal LDO_err by subtracting the 1A digital signal DIG_1A from target digital signal LDO_tar. Alternatively, subtraction circuit 110-2A may generate second digital signal LDO_err by subtracting target digital signal LDO_tar from the 1A digital signal DIG_1A. It will be assumed that second digital signal LDO_err is generated by subtracting target digital signal LDO_tar from the 1A digital signal DIG_1A. A most significant bit of second digital signal LDO_err may indicate a polarity. Second digital signal LDO_err refers to a digital error signal of any of LDO regulators 100A through 100D.

Subtraction circuit 110-2A may perform a post-processing operation by inverting a value of bits constituting second digital signal LDO_err other than a polarity bit where a most significant bit indicating the polarity information of second digital signal LDO_err has a first logic value, and outputting the value of the bits constituting second digital signal LDO_err where the most significant bit of second digital signal LDO_err has a second logic value.

Figure 3:
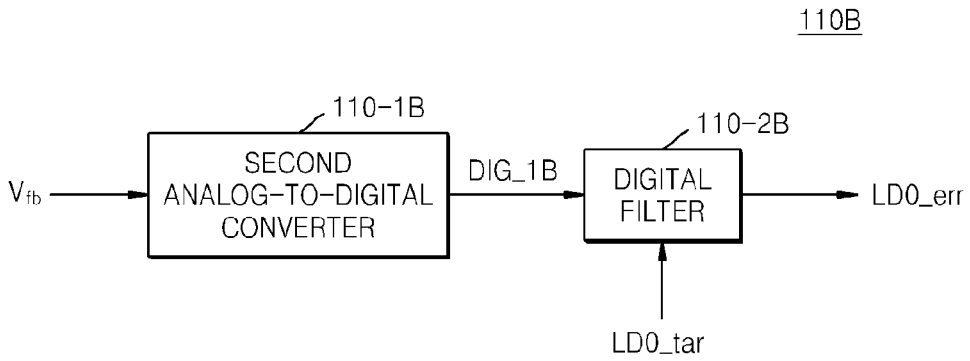
FIG. 3 is a block diagram illustrating a detailed structure of an ADC of FIGS. 1A through 1D, according to another embodiment of the inventive concept.

FIG. 3 is a block diagram illustrating a detailed structure of an ADC 110B of FIGS. 1A through 1D, according to another embodiment of the inventive concept.

Referring to FIG. 3, ADC 110B comprises a second ADC 110-1B and a digital filter 110-2B.

Second ADC 110-1B converts feedback analog voltage signal $V_{fb}$ that is input from output circuit 104 into a 1B digital signal DIG_1B of M (M>1) bits. The number M of bits of the 1B digital signal is determined to be less than the number N that determines a level of resolution of any of LDO regulators 100A through 100D. For example, where the number N is set to 16, the number M may be set to 10. Alternatively, the numbers M and N may be determined in various other ways in consideration of the performance of a system using any of LDO regulators 100A through 100D.

Digital filter 110-2B receives the 1B digital signal DIG_1B output from second ADC 110-1B, and it outputs second digital signal LDO_err of N (N>M) bits based on average filtering or subtraction performed on target digital signal LDO_tar. A most significant bit of second digital signal LDO_err may indicate a polarity.

Digital filter 110-2B generates a 1C digital signal DIC_1C of N bits by performing cumulative average filtering on the 1B digital signal DIG_1B of M bits at every sampling time, and generates second digital signal LDO_err of N bits corresponding to a difference between the 1C digital signal DIG_1C of N bits and target digital signal LDO_tar. For example, digital filter 110-2B may generate second digital signal LDO_err by subtracting the 1C digital signal DIG_1C from target digital signal LDO_tar. Alternatively, digital filter 110-2B may generate second digital signal LDO_err by subtracting target digital signal LDO_tar from the 1C digital signal DIG_1C. For explanation purposes, it is assumed that second digital signal LDO_err is generated by subtracting target digital signal LDO_tar from the 1C digital signal DIG_1C.

Figure 4:
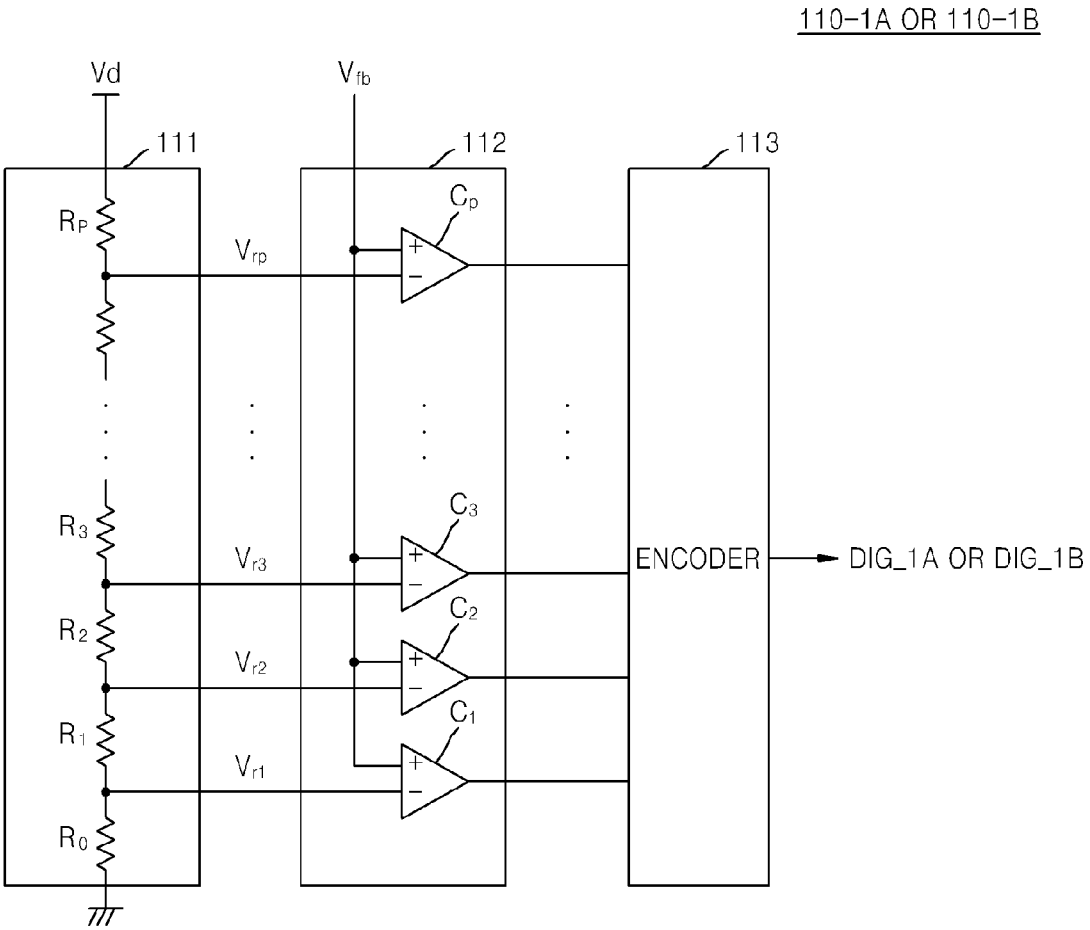
FIG. 4 is a block diagram illustrating a detailed structure of the ADC of FIG. 3, according to an embodiment of the inventive concept.

FIG. 4 is a block diagram illustrating a detailed structure of first ADC 110-1A or second ADC 110-1B of FIG. 2 or 3, according to an embodiment of the inventive concept.

Referring to FIG. 4, first or second ADC 110-1A or 110-1B comprises a reference voltage generating circuit 111, a comparison circuit 112, and an encoder 113.

Reference voltage generating circuit 111 comprises resistors $R_0$ through $R_p$ connected in series between a power voltage source Vd and the ground, and generates p reference voltages $V_{r1}$ through $V_{rp}$ through nodes disposed between resistors $R_0$ through $R_p$ connected in series. Resistance values of resistors $R_0$ through $R_p$ may be set to be the same. To realize ADC 110-1B of M bits, the number p may be determined to be $(2^M-1)$. That is, to realize ADC 110-1B of 10 bits, $2^{10}$ resistance elements must be connected in series between power voltage source Vd and the ground. Input voltage Vin that is applied to output circuit 140 may be used as a voltage of power voltage source Vd.

Comparison circuit 112 comprises p comparators $C_1$ through $C_p$. A reference voltage matched to each of comparators $C_1$ through $C_p$ is applied to a first input terminal of each of comparators $C_1$ through $C_p$, and feedback analog voltage signal $V_{fb}$ is applied to a second input terminal of each of comparators $C_1$ through $C_p$. To realize ADC 110-1B of M bits, $(2^M-1)$ comparators may be necessary. That is, to realize ADC 110-1B of 10 bits, $(2^{10}-1)$ comparators may be necessary.

The first input terminal of each of comparators $C_1$ through $C_p$ may be set as a negative (−) input terminal, and the second input terminal may be set as a positive (+) input terminal. Alternatively, the first input terminal of each of comparators $C_1$ through $C_p$ may be set as a positive (+) input terminal, and the second input terminal may be set as a negative (−) input terminal.

Reference voltage $V_{r1}$ is applied to the first input terminal of comparator $C_1$, reference voltage $V_{r2}$ is applied to the first input terminal of comparator $C_2$, and reference voltage $V_{rp}$ is applied to the first input terminal of comparator $C_p$. Reference voltages matched to corresponding comparators are respectively applied to the first input terminals of the remaining comparators in the same manner.

Each of comparators $C_1$ through $C_p$ compares a voltage of the first input terminal with a voltage of the second input terminal and outputs a signal having a logic value corresponding to a result of the comparison. For example, assuming that the first input terminal is set as a negative (−) input terminal and the second input terminal is set as a positive (+) input terminal, each of comparators $C_1$ through $C_p$ generates an output having a logic state "High(1)" where a voltage of an analog voltage signal DAC_out is equal to or greater than a reference voltage, and generates an output having a logic state "Low(0)" where the voltage of analog voltage signal DAC_out is less than the reference voltage.

Encoder 113 generates a digital signal by encoding output signals of comparators $C_1$ through $C_p$ of comparison circuit 112. For example, where the number p is $(2^M-1)$, encoder 113 generates the 1B digital signal DIG_1B of M bits. Alternatively, where the number p is $(2^N-1)$, encoder 113 generates the 1A digital signal DIG_1A of N bits.

Figure 5:
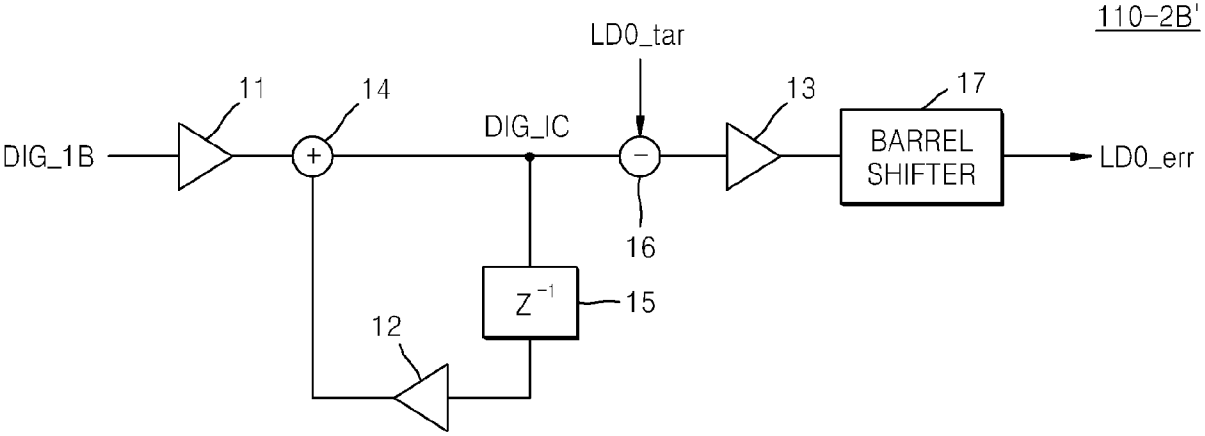
FIG. 5 is a block diagram illustrating a detailed structure of a digital filter of FIG. 3, according to another embodiment of the inventive concept.

FIG. 5 is a block diagram illustrating a detailed structure of a digital filter 110-2B' of FIG. 3, according to an embodiment of the inventive concept.

Referring to FIG. 5, digital filter 110-2B' comprises first through third multipliers 11, 12, and 13, an adder 14, a delayer 15, a subtractor 16, and a barrel shifter 17.

First multiplier 111 receives the 1B digital signal DIG_1B of M bits output from ADC 110-1B, and outputs a first operation signal of N bits obtained by multiplying the 1B digital signal DIG_1B by a first coefficient, to adder 14.

Adder 14 outputs a second operation signal of N bits obtained by adding a third operation signal output from second multiplier 12 to the first operation signal, to delayer 15 and subtractor 16. The second operation signal output from adder 14 corresponds to a signal obtained by performing average filtering on the 1B digital signal DIG_1B. That is, the second operation signal may be referred to as the 1C digital signal DIG_1C.

Delayer 15 delays the second operation signal by a sampling time and outputs the delayed second operation signal to second multiplier 12. Second multiplier 12 outputs the third operation signal of N bits obtained by multiplying a signal output from delayer 15 by a second coefficient to adder 14.

Subtractor 16 outputs a fourth operation signal of N bits obtained by operating a difference between target digital signal LDO_tar and the 1C digital signal DIG_1C, to third multiplier 13. For example, subtractor 16 outputs the fourth operation signal of N bits obtained by subtracting target digital signal LDO_tar from the 1C digital signal DIG_1C, to third multiplier 13. A most significant bit of the fourth operation signal of N bits may indicate a polarity.

Third multiplier 13 outputs a fifth operation signal of N bits obtained by multiplying the fourth operation signal by a third coefficient, to barrel shifter 17.

Barrel shifter 17 outputs second digital signal LDO_err obtained by shifting the fifth operation signal by at least one bit to the right. Once second digital signal LDO_err is shifted by one bit to the right by barrel shifter 17, second digital signal LDO_err is the same as a result obtained by multiplying the fifth operation signal by 2. If second digital signal LDO_err is shifted by 2 bits to the right by barrel shifter 17, second digital signal LDO_err is the same as a result obtained by multiplying the fifth operation signal by 4. That is, where the number of bits shifted to the right by barrel shifter 17 is n, a value obtained by multiplying an input signal by $2^n$ is output.

Each of the first coefficient, the second coefficient, and the third coefficient may be determined to be greater than 0 and less than 1.

Figure 6:
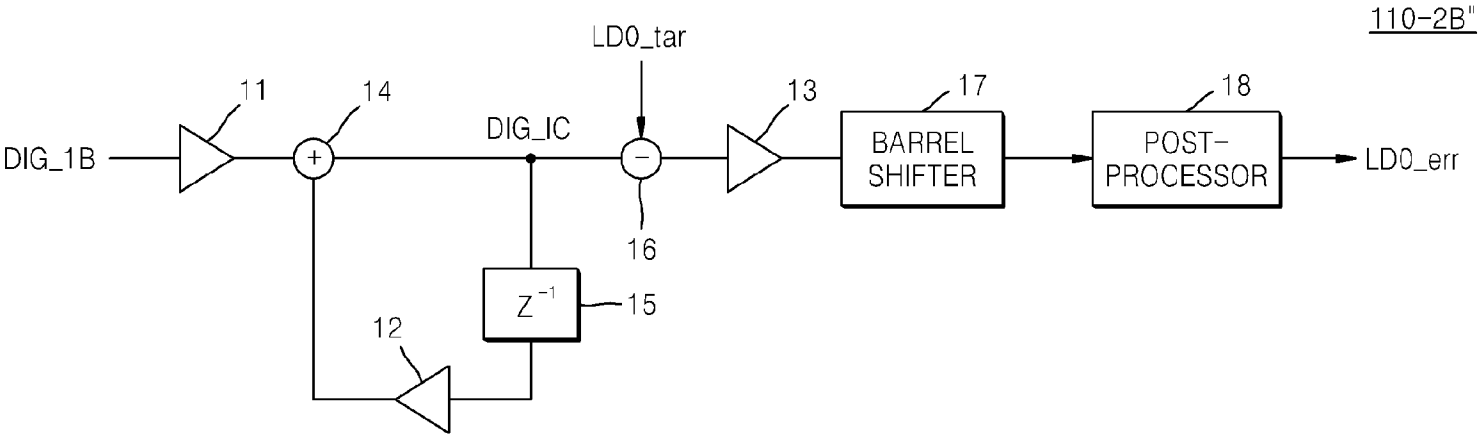
FIG. 6 is a block diagram illustrating a detailed structure of a digital filter of FIG. 3, according to another embodiment of the inventive concept.

FIG. 6 is a block diagram illustrating a detailed structure of a digital filter 110-2B" of FIG. 3, according to another embodiment of the inventive concept.

Referring to FIG. 6, digital filter 110-2B" comprises the first through third multipliers 11, 12, and 13, adder 14, delayer 15, subtractor 16, barrel shifter 17, and a post-processor 18.

Digital filter 110-2B" of FIG. 6 is different from digital filter 110-2B' of FIG. 5 in that post-processor 18 is additionally provided.

Operations of the first, second, and third multipliers 11, 12, and 13, adder 14, delayer 15, subtractor 16, and barrel shifter 17 of FIG. 6 have already been explained with reference to FIG. 5, and thus only an operation of post-processor 18 will be explained.

Post-processor 18 receives second digital signal LDO_err output from barrel shifter 17, and inverts and outputs a value of bits constituting second digital signal LDO_err other than a polarity bit where a most significant bit that is the polarity bit of second digital signal LDO_err has a first logic value, and outputs the value of the bits constituting second digital signal LDO_err where the polarity bit of second digital signal LDO_err has a second logic value. For example, the first logic value may be set to '1', and the second logic value may be set to '0'. Alternatively, the first logic value may be set to '0', and the second logic value may be set to '1'.

Figure 7:
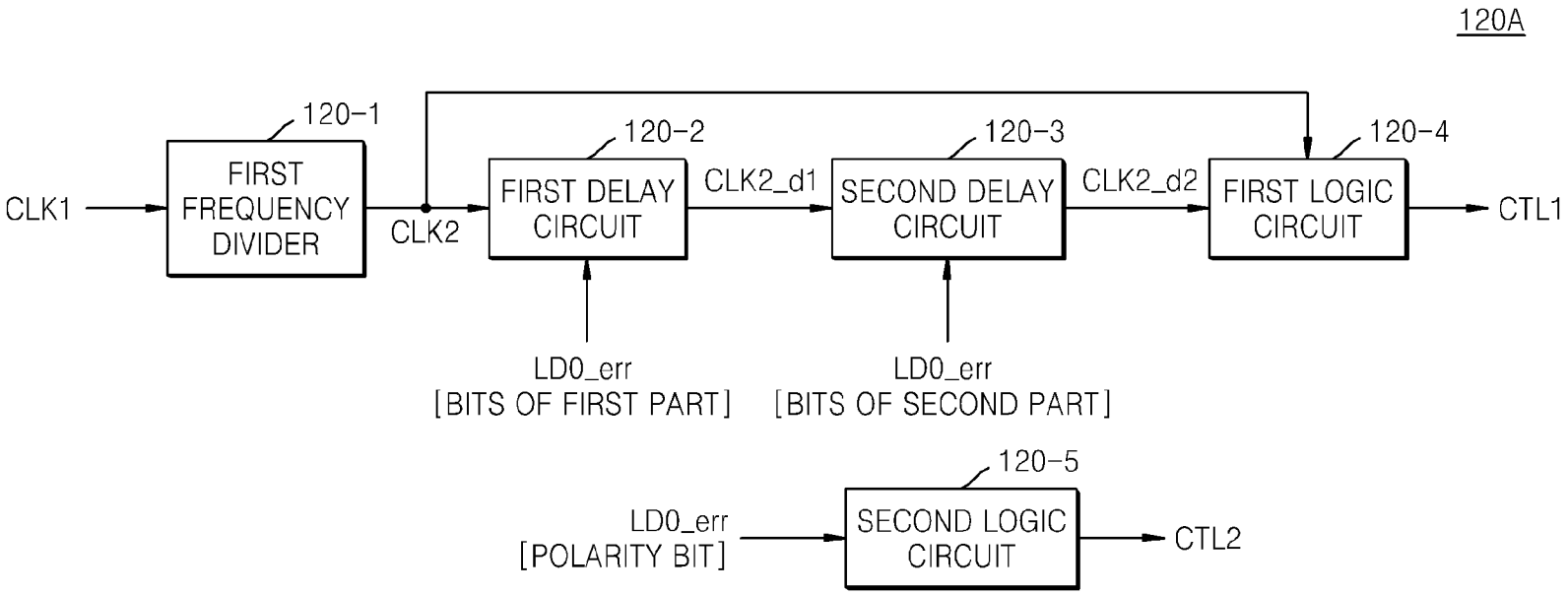
FIG. 7 is a block diagram illustrating a detailed structure of a phase synthesizing unit of FIGS. 1A through 1D, according to an embodiment of the inventive concept.

FIG. 7 is a block diagram illustrating a detailed structure of a phase synthesizing unit 120A of FIGS. 1A through 1B, according to an embodiment of the inventive concept.

Referring to FIG. 7, phase synthesizing unit 120A comprises a first frequency divider 120-1, a first delay circuit 120-2, a second delay circuit 120-3, a first logic circuit 120-4, and a second logic circuit 120-5.

Phase synthesizing unit 120A generates first control signal CTL1 and second control signal CTL2 based on second digital signal LDO_err. Second digital signal LDO_err comprises a most significant bit indicating the polarity information, bits of a first part comprising a preset number of high-order bits indicating a delay value of first delay circuit 120-2, and bits of a second part comprising a preset number of low-order bits indicating a delay value of second delay circuit 120-3.

Where second digital signal LDO_err comprises 16 bits, first delay circuit 120-2 may be controlled by using a value of [14:11] bits and second delay circuit 120-3 may be controlled by using a value of [10:0] bits.

First frequency divider 120-1 receives a first clock signal CLK1, and outputs a second clock signal CLK2 whose pulse is generated at every preset integer multiple of first clock signal CLK1 which is equal to or greater than 2. First frequency divider 120-1 may determine a generation cycle of second clock signal CLK2 based on the number of bits of the first part of second digital signal LDO_err. For example, where the number of bits of the first part is 4, the preset integer multiple may be determined to be $2^4$. That is, where the number of bits of the first part is 4, a pulse of second clock signal CLK2 is generated whenever 16 pulses of first clock signal CLK1 are generated.

Figure 18:
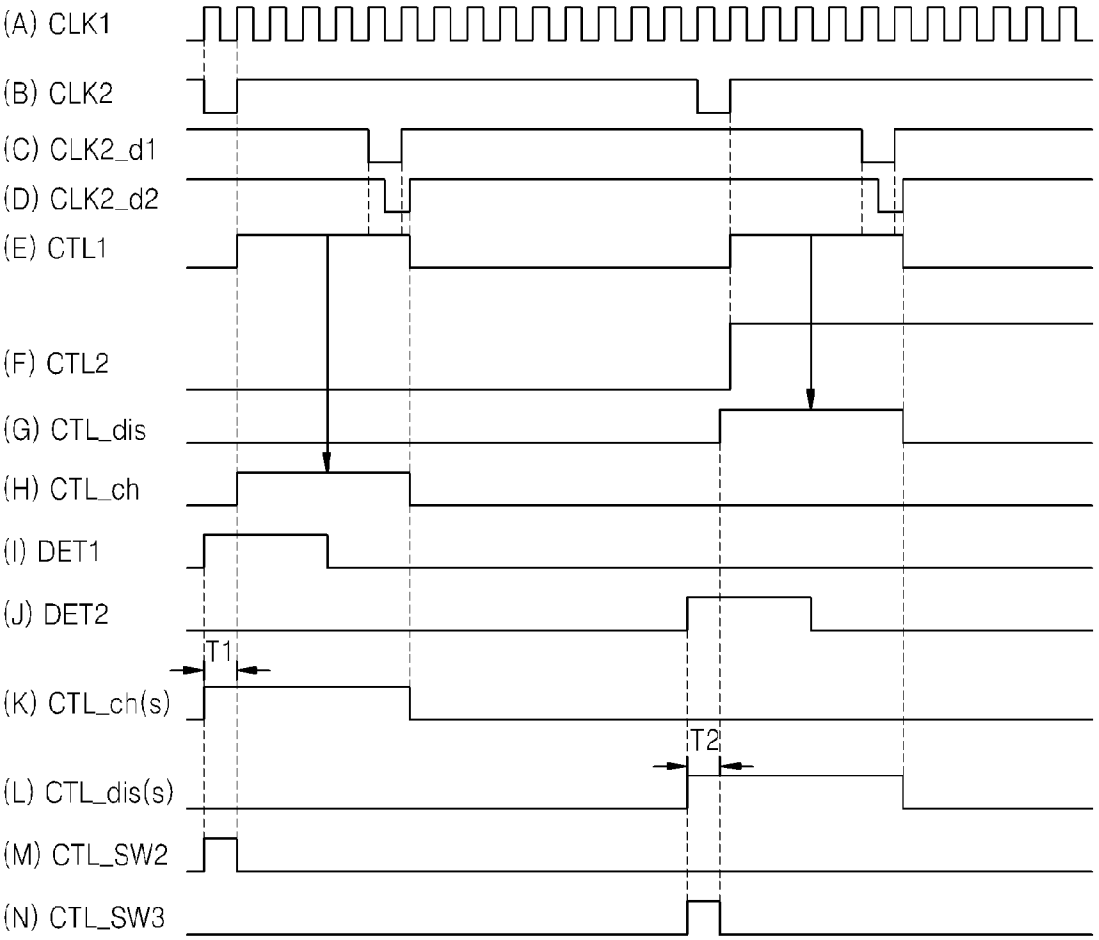
FIG. 18 is a timing diagram illustrating signals that are generated in an LDO regulator, according to an embodiment of the inventive concept.

FIG. 18 is a timing diagram illustrating signals that are generated in any of LDO regulators 100A through 100D, according to an embodiment of the inventive concept. In FIG. 18, A illustrates first clock signal CLK1, and B illustrates second clock signal CLK2. Referring to A and B, first clock signal CLK1 is input to first frequency divider 120-1, and a pulse of second clock signal CLK2 is generated whenever 16 pulses of first clock signal CLK1 are generated.

First delay circuit 120-2 receives second clock signal CLK2, and outputs a 2And clock signal CLK2_d1 obtained by delaying second clock signal CLK2 by one cycle of first clock signal CLK1 based on the value of the bits of the first part constituting second digital signal LDO_err. For example, where second digital signal LDO_err comprises 16 bits, first delay circuit 120-2 may be controlled using a value of [14:11] bits. In detail, where the value of the [14:11] bits is [0101], second clock signal CLK2 is delayed for a time corresponding to 5 cycles of first clock signal CLK1 due to first delay circuit 120-2, and then is output. The 2And clock signal CLK2_d1 that is delayed for the time corresponding to 5 cycles of first clock signal CLK1 by first delay circuit 120-2 and then is output is illustrated in C of FIG. 18.

Second delay circuit 120-3 receives the 2And clock signal CLK2_d1 output from first delay circuit 120-2, and outputs a 2Bnd clock signal CLK2_d2 obtained by delaying the 2And clock signal CLK2_d1 by a preset resolution time according to clock skew control based on the value of the bits of the second part constituting second digital signal LDO_err. For example, the resolution time that is set as an initial value may be determined as a time obtained by dividing one cycle of the first clock signal by $2^K$ (K is the number of bits of the second part). Alternatively, the resolution time that is set as an initial value may be determined to be less or greater by a predetermined amount than the time obtained by dividing the one cycle of the first clock signal by $2^K$. The 2Bnd clock signal CLK2_d2 is illustrated in D of FIG. 18.

First logic circuit 120-4 generates first control signal CTL1 having a pulse width corresponding to a sum of delay values of first delay circuit 120-2 and second delay circuit 120-3 based on second clock signal CLK2 and the 2Bnd clock signal CLK2_d2. For example, first logic circuit 120-4 may generate first control signal CTL1 having a pulse width from a point of time where a pulse of second clock signal CLK2 is generated to a point of time where a pulse of the 2Bnd clock signal CLK2_d2 is generated.

Second logic circuit 120-5 generates second control signal CTL2 having a logic value corresponding to the polarity bit information in second digital signal LDO_err. For example, second logic circuit 120-5 may generate second control signal CTL2 having a logic value corresponding to a most significant bit indicating the polarity information of second digital signal LDO_err.

Alternatively, an output of a polarity bit of second digital signal LDO_err generated in ADC 110 may be directly used as second control signal CTL2 without passing through second logic circuit 120-5. In detail, an output of a most significant bit indicating the polarity information of second digital signal LDO_err may be used as second control signal CTL2. In this case, second logic circuit 120-5 may be omitted.

Figure 8:
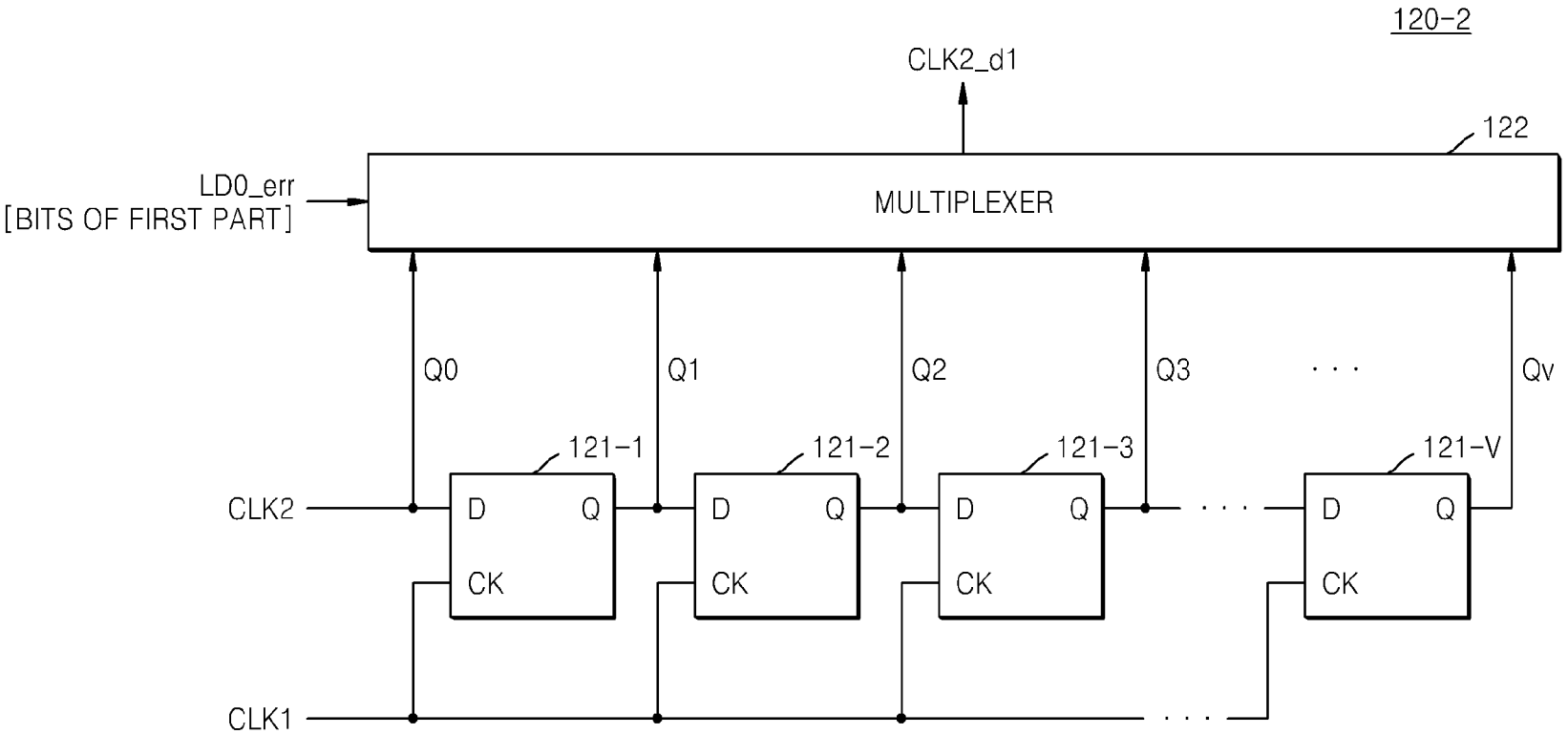
FIG. 8 is a block diagram illustrating a detailed structure of a first delay circuit of FIG. 7, according to an embodiment of the inventive concept.

FIG. 8 is a block diagram illustrating a detailed structure of first delay circuit 120-2 of FIG. 7, according to an embodiment of the inventive concept.

Referring to FIG. 8, first delay circuit 120-2 comprises multiple D flip-flops, that is, first through Vth D flip-flops 121-1 through 121-V, and a multiplexer 122.

The number V of the D flip-flops is determined by the value of the bits of the first part constituting second digital signal LDO_err. For example, where the number of bits of the first part is 4, the number V of the D flip-flops may be determined to be 15, that is, $(2^4-1)$.

First through Vth D flip-flops 121-1 through 121-V are connected in series. In detail, second clock signal CLK2 is applied to an input terminal D of first D flip-flop 121-1, and an output terminal Q is connected to input terminal D of second D flip-flop 121-2. Likewise, input terminal D and output terminal Q of each of first through Vth D flip-flops 121-1 through 121-V are connected in this manner.

First clock signal CLK1 is applied to a clock terminal CK of each of first through Vth D flip-flops 121-1 through 121-V. Then, second clock signal CLK2 that is delayed by 1 cycle of first clock signal CLK1 is output from first D flip-flop 121-1, second clock signal CLK2 that is delayed by 2 cycles of first clock signal CLK1 is output from second D flip-flop 121-1, and second clock signal CLK2 that is delayed by V cycles of first clock signal CLK1 is output from last Vth D flip-flop 121-V.

An input signal Q0 of first D flip-flop 121-1 and signals Q1 through Qv output from first through Vth D flip-flops 121-1 through 121-V are input to multiplexer 122. Multiplexer 122 selects and outputs one of signals Q0 through Qv that are input to (v+1) input terminals by using the value of the bits of the first part constituting second digital signal LDO_err.

Where the bits of the first part constituting second digital signal LDO_err are [14:11] and a value of the [14:11] bits is [0000], multiplexer 122 selects and outputs input signal Q0. Alternatively, where the value of the [14:11] is [0101], multiplexer 122 selects and outputs signal Q5.

Figure 9:
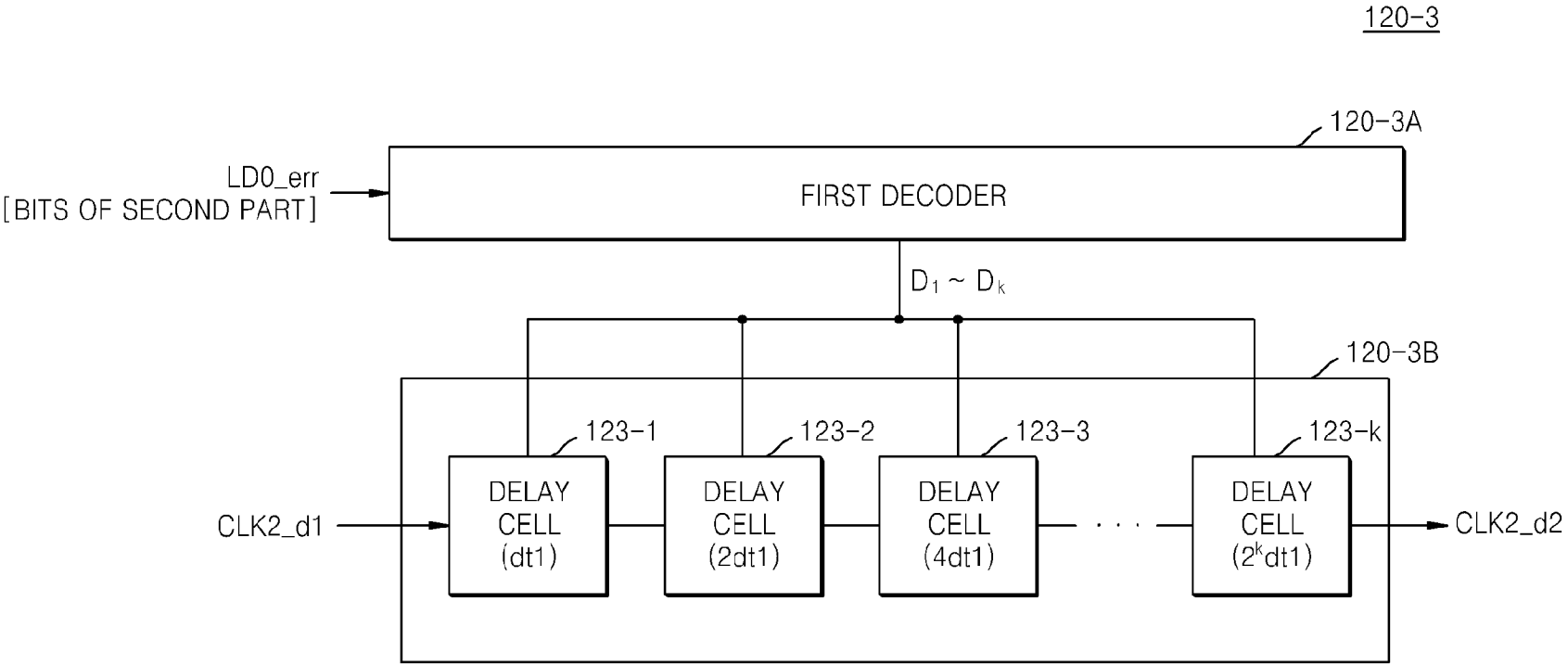
FIG. 9 is a block diagram illustrating a detailed structure of a second delay circuit of FIG. 7, according to an embodiment of the inventive concept.

FIG. 9 is a block diagram illustrating a detailed structure of second delay circuit 120-3 of FIG. 7, according to an embodiment of the inventive concept.

Referring to FIG. 9, second delay circuit 120-3 comprises a first decoder 120-3A and a first delay chain 120-3B.

First delay chain 120-3B has a circuit structure in which delay cells 123-1 through 123-*k* are connected in series. First delay chain 120-3B receives the 2And clock signal CLK2_d1, and outputs delayed 2Bnd clock signal CLK2_d2 to delay cells 123-1 through 123-*k* based on first decoding signals $D_1$ through $D_k$.

The number k of delay cells 123-1 through 123-*k* is determined to be the same as the number of bits of the second part constituting second digital signal LDO_err. For example, where [10:0] bits of second digital signal LDO_err are allocated as the bits of the second part, the number k of delay cells 123-1 through 123-*k* may be determined to be 11. Delay cells 123-1 through 123-*k* are controlled by first decoding signals $D_1$ through $D_k$ that are generated by first decoder 120-3A.

Where a delay time in delay cell 123-1 corresponding to a least significant bit is determined to be a first unit delay time dt1, a delay time in delay cell 123-2 corresponding to a second high-order bit is determined to be 2*dt1, and a delay time of delay cell 123-3 corresponding to a third high-order bit is determined to be 4*dt1. That is, as a delay cell of first delay chain 120-3B is shifted to an upper bit, a delay time of a delay cell is determined to be increased by two times.

Where the first unit delay time dt1 that is a delay time in delay cell 123-1 corresponding to the least significant bit is determined to be 125 ps, a delay time in delay cell 123-2 corresponding to the second high-order bit may be determined to be 0.25 ns. Also, a delay time in delay cell 123-11 corresponding to an $11^{th}$ high-order bit may be determined to be 32 ns.

First decoder 120-3A generates first decoding signals $D_1$ through $D_k$ for selecting delay cells constituting first delay chain 120-3B based on the value of the bits of the second part constituting second digital signal LDO_err. A first decoding value of first decoder 120-3A may be determined to be the same as the value of the bits of the second part constituting second digital signal LDO_err. For example, where the value of the bits of the second part constituting second digital signal LDO_err is [01000000011], the first decoding value may be determined to be [01000000011]. Also, first decoding signals D1 through D11 may be generated according to the first decoding value [01000000011]. First decoding signals $D_1$ through $D_k$ are respectively matched to delay cells 123-1 through 123-*k* in a one-to-one manner.

Delay cells selected based on values of first decoding signals $D_1$ through $D_k$ from among delay cells 123-1 123-*k* constituting first delay chain 120-3B delay an input signal by delay times of corresponding cells and output the delayed input signal. Also, delay cells not selected from delay cells 123-1 through 123-*k* constituting first delay chain 120-3B delay an input signal by a second unit delay time dt2. The second unit delay time dt2 is set to be a value less than the first unit delay time dt1. The second unit delay time dt2 may be set to be a value small enough to be disregarded compared with the first unit delay time dt1.

Where a value of [10:0] bits of second digital signal LDO_err is [01000000011], delay cells selected by first decoding signals $D_1$ through $D_k$ are 123-1, 123-2, and 123-10. If a unit delay time is disregarded, a total delay time in first delay chain 120-3B is a sum of delay times in three delay cells 123-1, 123-2, and 123-10.

Figure 10:
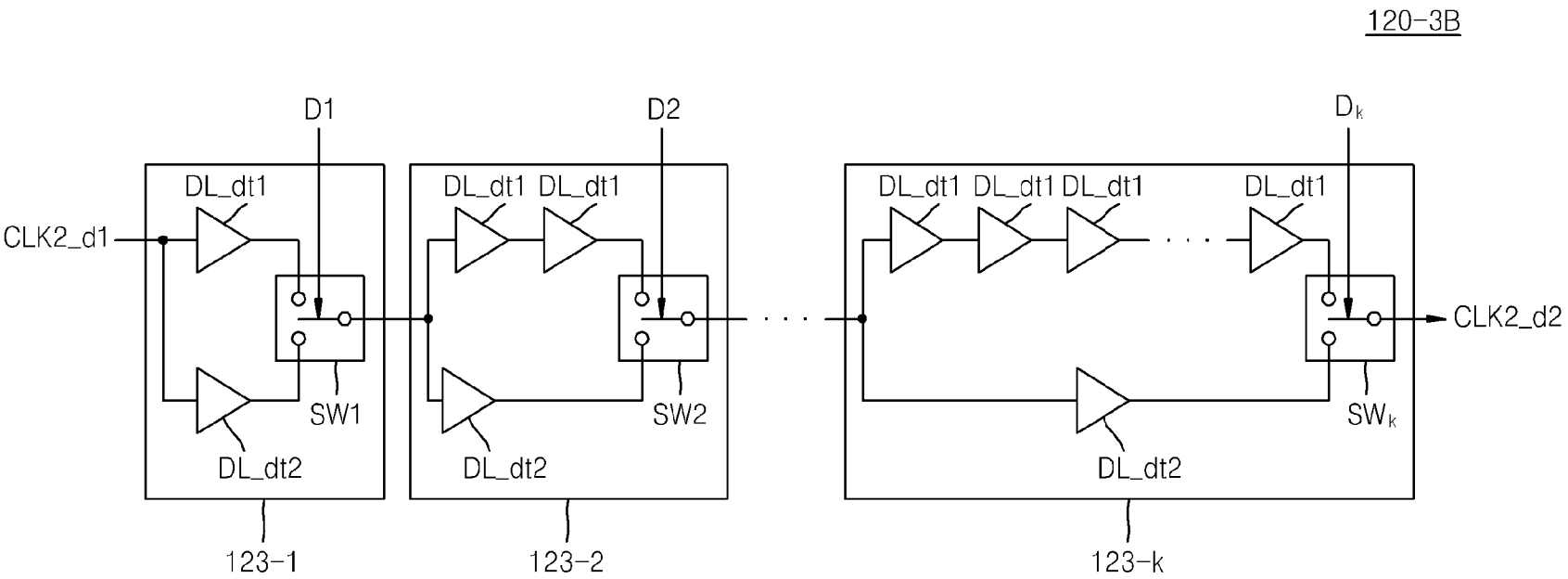
FIG. 10 is a block diagram illustrating a detailed structure of a delay chain of FIG. 9, according to an embodiment of the inventive concept.

FIG. 10 is a block diagram illustrating a detailed structure of first delay chain 120-3B of FIG. 9, according to an embodiment of the inventive concept.

Referring to FIG. 10, first delay chain 120-3B comprises delay cells 123-1 through 123-*k* connected in series. Each of delay cells 123-1 through 123-*k* selects one of a first terminal, which connects in series delay elements DL_dt1 each having the first unit delay times dt1 and the number of which corresponds to a delay time of a corresponding delay cell, and a second terminal of a delay element DL_dt2 that has the second unit delay time dt2 and is connected in parallel to the first terminal, and outputs the selected terminal A switching element SWi is controlled by a first decoding signal Di that is generated by decoder 120-3A based on the bits of the first part constituting second digital signal LDO_err.

In detail, delay cell 123-1 comprises one delay element DL_dt1 that delays and outputs an input signal by the first unit delay time dt1, one delay element DL_dt2 that is connected in parallel to delay element DL_dt1 and delays and outputs an input signal by the second unit delay time dt2, and switching element SW1. One of delay element DL_dt1 and delay element DL_dt2 is selected and output by switching element SW1. Switching element SW1 is controlled by first decoding signal D1 corresponding to a least significant bit from among the bits of the first part constituting second digital signal LDO_err. For example, where first decoding signal D1 has a first logic value (e.g., 1), delay cell 123-1 selects and outputs a signal that is delayed in delay element DL_dt1. In contrast, where first decoding signal D1 has a second logic value (e.g., 0), delay cell 123-1 selects and outputs a signal that is delayed in delay element DL_dt2.

Delay cell 123-*k* comprises $2^k$ delay elements DL_dt1 connected in series, one delay element DL_dt2, and switching element SWk. Switching element SWk selects one of a first terminal from which a signal delayed by the $2^k$ delay elements DL_dt1 connected in series is output and a second terminal from which a signal delayed by one delay element DL_dt2 that is connected in parallel to the first terminal is output. Switching element SWk is controlled by first decoding signal $D_k$ corresponding to a most significant bit from among the bits of the first part constituting second digital signal LDO_err. For example, where first decoding signal $D_k$ has a first logic value (e.g., 1), delay cell 123-*k* selects the first terminal to output a signal that is delayed in the $2^k$ delay elements DL_dt1. In contrast, where first decoding signal $D_k$ has a second logic value (e.g., 0), delay cell 123-*k* selects the second terminal to output a signal that is delayed in delay element DL_dt2.

Figure 11:
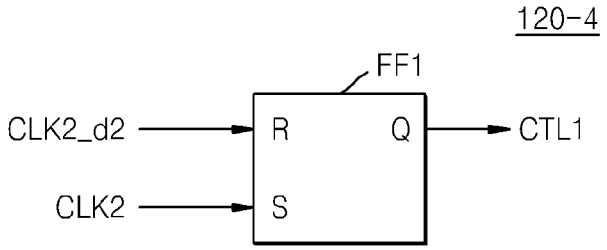
FIG. 11 is a block diagram illustrating a detailed structure of a first logic circuit of FIG. 7, according to an embodiment of the inventive concept.

FIG. 11 is a block diagram illustrating a detailed structure of first logic circuit 120-4 of FIG. 7, according to an embodiment of the inventive concept.

Referring to FIG. 11, first logic circuit 120-4 comprises an RS flip-flop FF1.

The 2Bnd clock signal CLK2_d2 output from second delay circuit 120-3 is applied to an R terminal of the RS flip-flop FF1, and second clock signal CLK2 output from first frequency divider 120-1 is applied to an S terminal of the RS flip-flop FF1.

Where second clock signal CLK2 is generated at the same timing as that in B of FIG. 18 and the 2Bnd clock signal CLK2_d2 is generated at the same timing as that in D of FIG. 18, first control signal CTL1 output from an output terminal Q of the RS flip-flop FF1 is generated as shown in E of FIG. 18.

Figure 12:
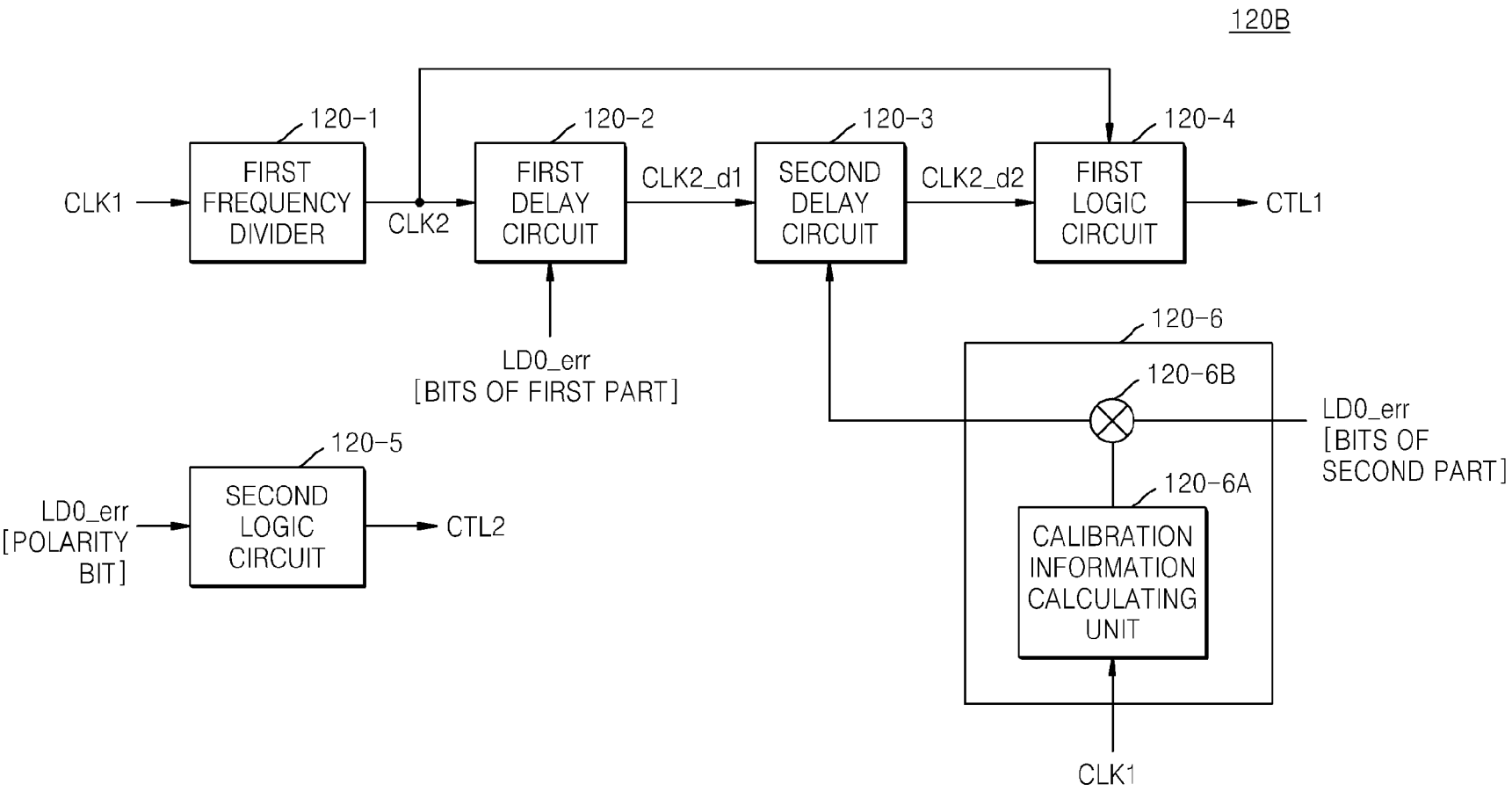
FIG. 12 is a block diagram illustrating a detailed structure of a phase synthesizing unit of FIGS. 1A through 1D, according to another embodiment of the inventive concept.

FIG. 12 is a block diagram illustrating a detailed structure of a phase synthesizing unit 120B of FIG. 1, according to another embodiment of the inventive concept.

Referring to FIG. 12, phase synthesizing unit 120B comprises first frequency divider 120-1, first delay circuit 120-2, second delay circuit 120-3, first logic circuit 120-4, second logic circuit 120-5, and a calibration circuit 120-6.

Phase synthesizing unit 120B is the same as phase synthesizing unit 120A of FIG. 7 except that calibration circuit 120-6 is additionally provided. First frequency divider 120-1, first delay circuit 120-2, second delay circuit 120-3, first logic circuit 120-4, and second logic circuit 120-5 have already been explained in detail with reference to FIG. 7, and thus an explanation thereof will not be repeated here.

Calibration circuit 120-6 comprises a calibration information calculating unit 120-6A and a fourth multiplier 120-6B.

Calibration information calculating unit 120-6A calculates a skew calibration value corresponding to a value that is delayed for 1 cycle of first clock signal CLK1 in a circuit equivalent to second delay circuit 120-3 of FIG. 9. The skew calibration value is the same value as a skew value of first clock signal CLK1 that is generated by second delay circuit 120-3.

Fourth multiplier 120-6B outputs a value of normalized bits of the second part by multiplying the bits of the second part constituting second digital signal LDO_err that is input to phase synthesizing unit 120B by the skew calibration value. The value of the normalized bits of the second part output from fourth multiplier 120-6B is applied to second delay circuit 120-3. Accordingly, a change in the amount of delay due to a change in process characteristics and a voltage that occurs in second delay circuit 120-3 may be offset.

Figure 13:
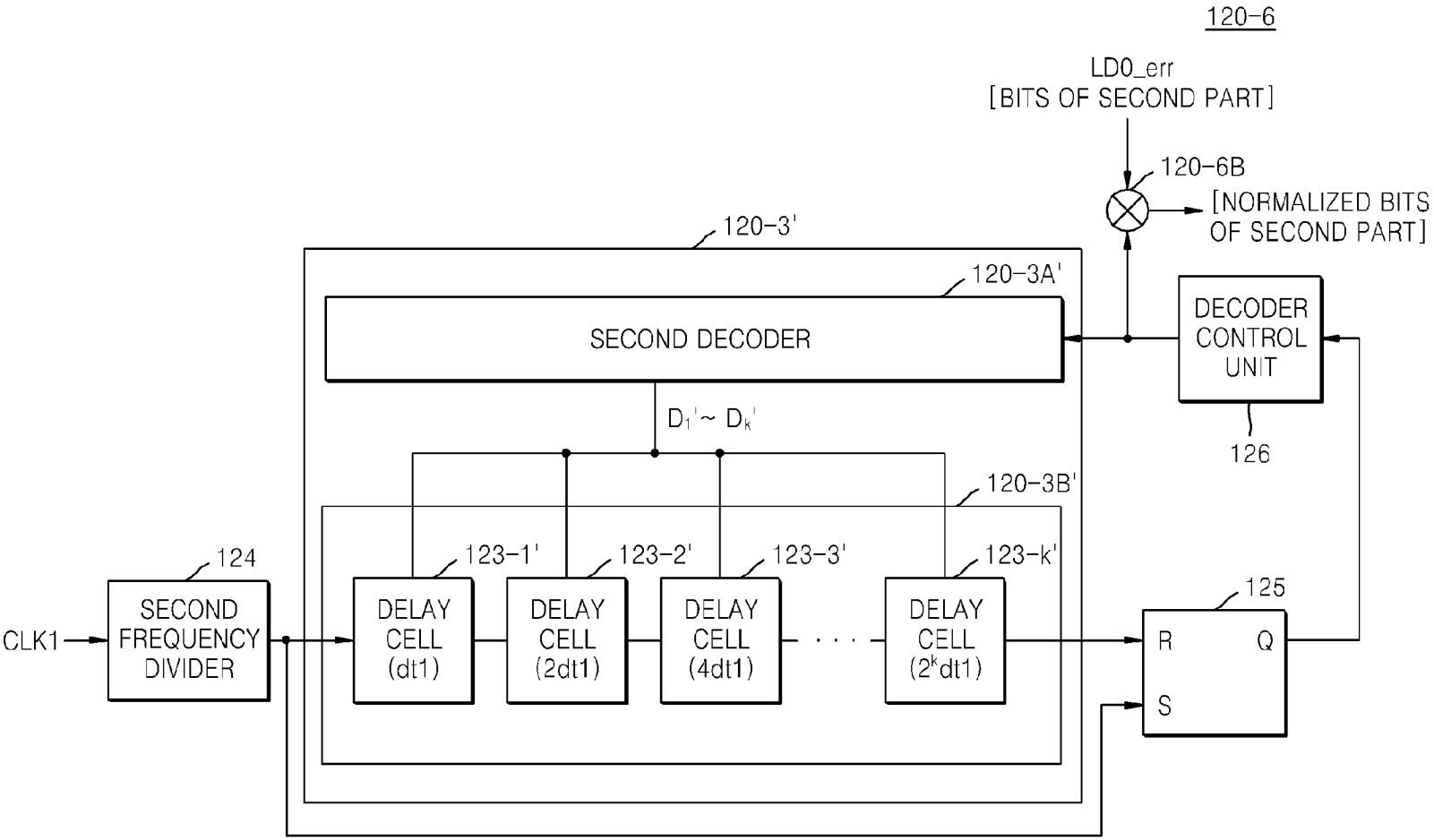
FIG. 13 is a block diagram illustrating a detailed structure of a calibration circuit of FIG. 12, according to an embodiment of the inventive concept.

FIG. 13 is a block diagram illustrating a detailed structure of calibration circuit 120-6 of FIG. 12, according to an embodiment of the inventive concept.

Referring to FIG. 13, calibration circuit 120-6 comprises a 2'nd delay circuit 120-3', a second frequency divider 124, an RS flip-flop 125, a decoder control unit 126, and fourth multiplier 120-6B.

Second frequency divider 124 receives first clock signal CLK1, and divides and outputs first clock signal CLK1. For example, where a frequency of first clock signal CLK1 is 32 MHz, a clock signal of 16 MHz is output from second frequency divider 124. A signal output from second frequency divider 124 is referred to as a 1And clock signal CLK1A.

The 2'nd delay circuit 120-3' has the same circuit structure as that of second delay circuit 120-3 of FIG. 9. The 2'nd delay circuit 120-3' comprises a second decoder 120-3A', and a second delay chain 130-3B'. Second delay chain 120-3B' comprises delay cells 123-1' through **123-*k*'** connected in series.

The 1And clock signal CLK1A is input to second delay chain 130-3B'. Second delay chain 130-3B' delays the 1And clock signal CLK1A by controlling delay cells 123-1' through **123-*k* by using second decoding signals $D_1'$ through $D_k'$ output from second decoder 120-3A'. A signal output from second delay chain 130-3B' is referred to as a 1Bnd clock signal CLK1**A_d.

The 1Bnd clock signal CLK1A_d is applied to an R terminal of the RS flip-flop 125, and the 1And clock signal CLK1A is applied to an S terminal of the RS flip-flop 125. A signal output from an output terminal Q of the RS flip-flop 125 is applied to decoder control unit 126.

Decoder control unit 126 generates a skew calibration value by increasing or reducing a second decoding value that is set as a default value of second decoder 120-3A' based on a logic value of the signal that is output to the Q terminal of the RS flip-flop 125. Decoder control unit 126 may increase or reduce the second decoding value comprising k bits by 1 based on the logic value of the signal that is output to the Q terminal.

Second decoder 120-3A' outputs second decoding signals $D_1'$ through $D_k'$ corresponding to the second decoding value that is controlled by decoder control unit 126 to second delay chain 130-3B'.

In detail, a second logic value (e.g., 0) is output to the Q terminal of the RS flip-flop 125 according to an initial skew value in second delay chain 130-3B'. Where the second logic value (e.g., 0) is applied to decoder control unit 123, decoder control unit 123 increases the second decoding value. The second decoding value is increased until a first logic value (e.g., 1) is applied from the RS flip-flop 125 to decoder control unit 126. Where the first logic value (e.g., 1) is applied from the RS flip-flop 125 to decoder control unit 126, decoder control unit 123 reduces the second decoding value.

Accordingly, the second decoding value of second decoder 120-3A' corresponding to a value that is delayed for 1 cycle of first clock signal CLK1 in the 2'nd delay circuit 120-3' is converged by being repeatedly increased and reduced. The converged second decoding value is the skew calibration value.

Fourth multiplier 120-6B outputs a value of normalized bits of the second part by multiplying the bits of the second part constituting second digital signal LDO_err that is input to phase synthesizing unit 120B by the skew calibration value that is generated by decoder control unit 123. The value of the normalized bits of the second part output from fourth multiplier 120-6B is applied to the 2'nd delay circuit 120-3'.

Figure 14:
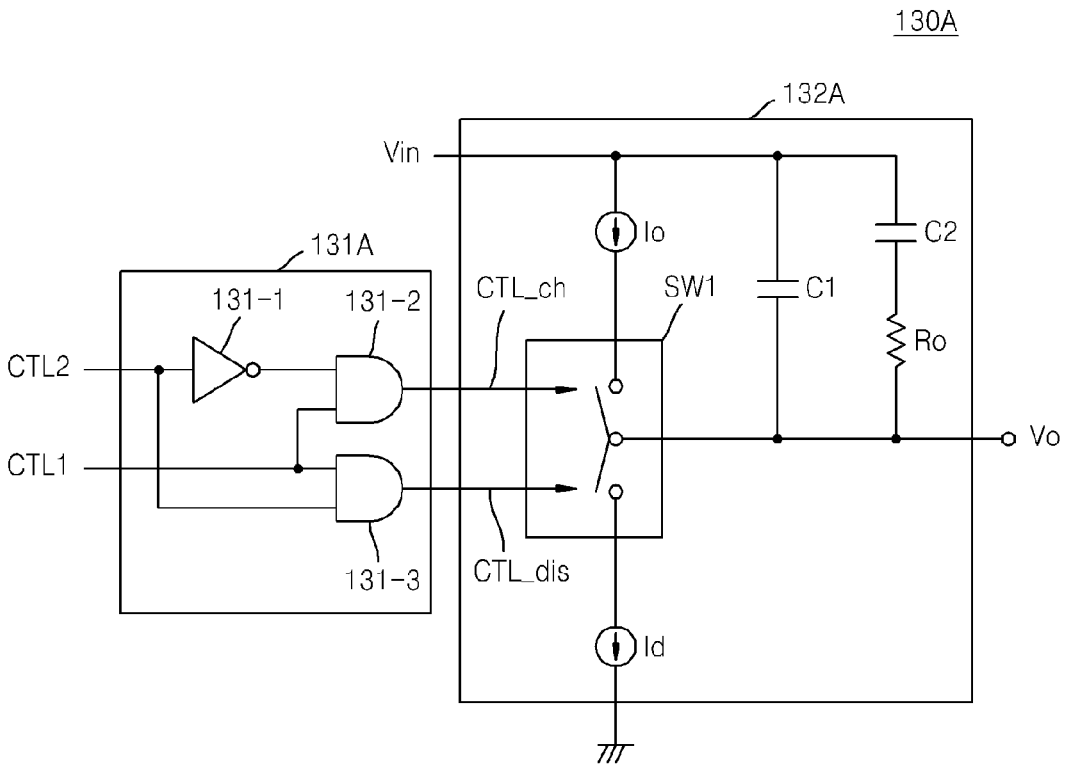
FIG. 14 is a block diagram illustrating a detailed structure of a charge pump circuit of FIGS. 1A through 1D, according to an embodiment of the inventive concept.

FIG. 14 is a block diagram illustrating a detailed structure of a charge pump circuit 130A of FIGS. 1A through 1D, according to an embodiment of the inventive concept.

Referring to FIG. 14, charge pump circuit 130A comprises a pre-processing unit 131A and a charge pump 132A.

Although pre-processing unit 131A is designed to be included in charge pump circuit 130A in FIG. 14, pre-processing unit 131A may be designed to be separate from charge pump circuit 130A. Alternatively, pre-processing unit 131A may be designed to be included in phase synthesizing unit 120.

Pre-processing unit 131A generates a first charge control signal CTL_ch and a first discharge control signal CTL_dis for switching a charge or discharge operation of charge pump 132A by using second control signal CTL2 and first control signal CTL1 that are input from phase synthesizing unit 120.

Pre-processing unit 131A comprises an inverter 131-1 and first and second AND gates 131-2 and 131-3.

Second control signal CTL2 is applied to an input terminal of inverter 131-1 and a second input terminal of second AND gate 131-3. First control signal CTL1 is applied to a second input terminal of first AND gate 131-2 and a first input terminal of second AND gate 131-3. Also, an output signal of inverter 131-1 is applied to a first input terminal of first AND gate 131-2.

First AND gate 131-2 outputs first charge control signal CTL_ch having a logic state '1' where a logic state of second control signal CTL2 is '0' and a logic state of first control signal CTL1 is '1', and it outputs the first change control signal CTL_ch having a logic state '0' in other cases.

Where second control signal CTL2 is generated at the same timing as that in F of FIG. 18 and first control signal CTL1 is generated at the same timing as that in E of FIG. 18, first charge control signal CTL_ch is generated at the same timing as that in H of FIG. 18. Also, second AND gate 131-3 outputs first discharge control signal CTL_dis having a logic state '1' where a logic state of second control signal CTL2 is '1' and a logic state of first control signal CTL1 is '1', and outputs first discharge control signal CTL_dis having a logic state '0' in other cases.

Where second control signal CTL2 is generated at the same timing as that in F of FIG. 18 and first control signal CTL1 is generated at the same timing as that in E of FIG. 18, first discharge control signal CTL_dis is generated at the same timing as that in G of FIG. 18.

Charge pump 132A comprises a first switch SW1, a source current source Io, a sync current source Id, capacitors C1 and C2, and a resistor Ro. Vin denotes an input voltage that is a power voltage applied to any of LDO regulators 100A through 100D.

When a charge loop is selected by charge pump 132A, source current source Io is turned on and sync current source Id is turned off. In contrast, where a discharge loop is selected by charge pump 132A, sync current source Id is turned on and source current source Io is turned off.

Where first charge control signal CTL_ch having a logic state '1' is applied from pre-processing unit 131A to first switch SW1, first switch SW1 forms a charge loop in charge pump 132*a*. Once the charge loop is formed, source current source Io is turned on and sync current source Id is turned off. Accordingly, current output from source current source Io is supplied to capacitors C1 and C2. As capacitors C1 and C2 are charged, output control voltage Vo generated in charge pump 132A is increased. Output control voltage Vo generated in charge pump 132A is increased in proportion to a length of a period where the charge loop is formed. Also, the length of the period for which the charge loop is formed is determined by a length of a period where the logic state of first control signal CTL1 is maintained at '1'.

Where first discharge control signal CTL_dis having a logic state '1' is applied from pre-processing unit 131A to first switch SW1, first switch SW1 forms a discharge loop in charge pump 132A. Once the discharge loop is formed, sync current source Id is turned on and source current source Io is turned off. Accordingly, a voltage of capacitors C1 and C2 is discharged through a ground terminal. That is, discharge current flows through sync current source Id to the ground terminal. Accordingly, as voltage of capacitors C1 and C2 is discharged, output control voltage Vo generated in charge pump 132A is reduced. Output control voltage Vo generated in charge pump 132A is reduced in proportion to a length of a period where the discharge loop is formed. Also, the length of the period for which the discharge loop is formed is determined by a length of a period where the logic state of first control signal CTL1 is maintained at '1'.

During a period where both first charge control signal CTL_ch and first discharge control signal CTL_dis are maintained at a logic state '0', both the charge loop and the discharge loop of charge pump 132A are opened. Where leakage current is disregarded during a period where both the charge loop and the discharge loop are opened, output control voltage Vo generated in charge pump 132A is not changed.

Figure 15:
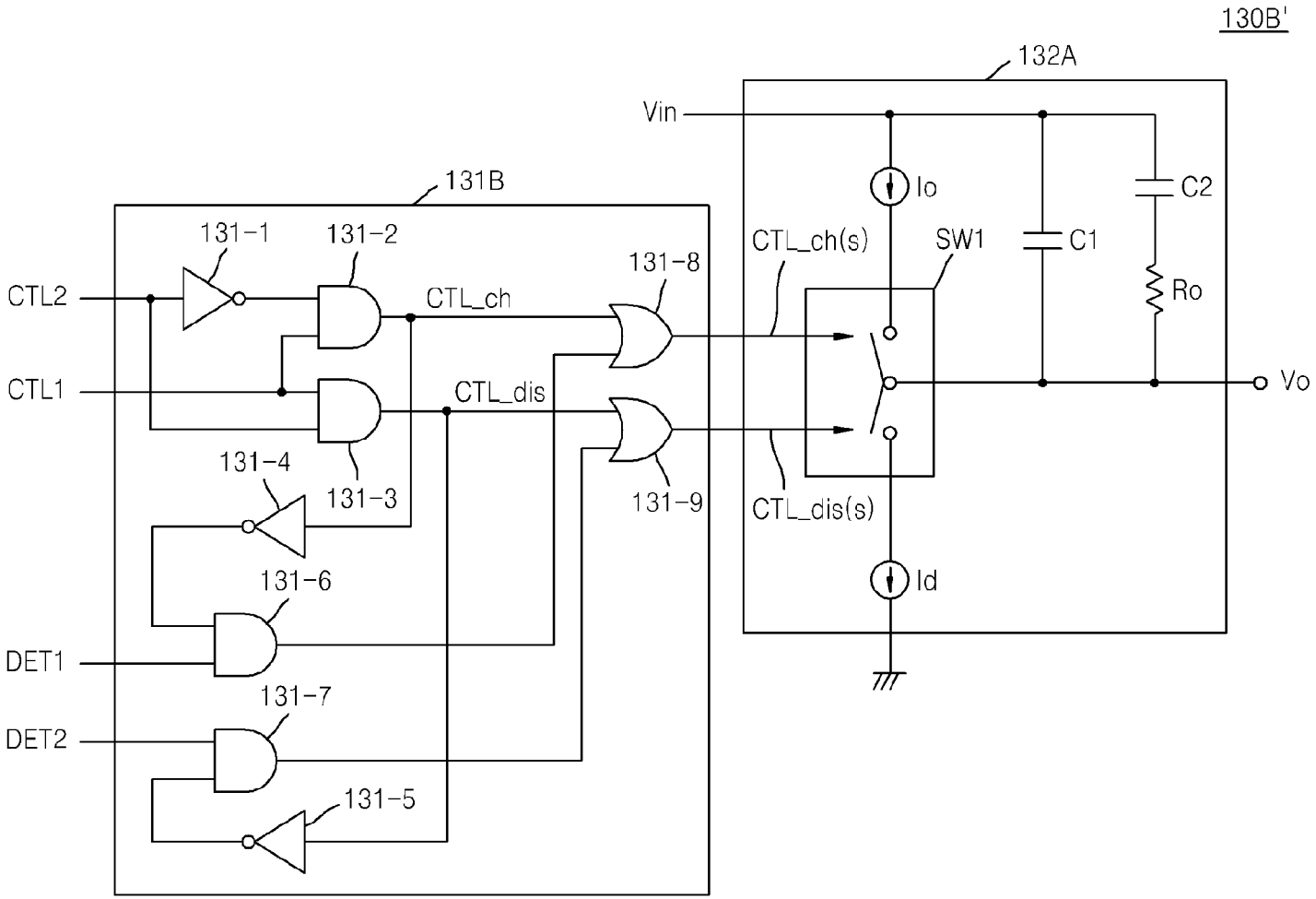
FIG. 15 is a block diagram illustrating a detailed structure of a charge pump circuit of FIGS. 1A through 1D, according to another embodiment of the inventive concept.

FIG. 15 is a block diagram illustrating a detailed structure of a charge pump circuit 130B' of FIGS. 1A through 1D, according to another embodiment of the inventive concept.

Referring to FIG. 15, charge pump circuit 130B' comprises a pre-processing unit 131B and charge pump 132A.

Although pre-processing unit 131B is designed to be included in charge pump circuit 130B' in FIG. 15, pre-processing unit 131B may be designed to be separated from charge pump circuit 130B'. Alternatively, pre-processing unit 131B may be designed to be included in phase synthesizing unit 120.

Pre-processing unit 131B generates a second charge control signal CTL_ch(s) and a second discharge control signal CTL_dis(s) for controlling a charge or discharge operation of charge pump 132A by using first control signal CTL1 and second control signal CTL2, which are input from phase synthesizing unit 120, and first detection signal DET1 and second detection signal DET2, which are input from window level detection unit 170.

Pre-processing unit 131B comprises first through third inverters 131-1, 131-4, and 131-5, first through fourth AND gates 131-2, 131-3, 131-6, and 131-7, and first and second OR gates 131-8 and 131-9.

Second control signal CTL2 is applied to an input terminal of first inverter 131-1 and a second input terminal of second AND gate 131-3. First control signal CTL1 is applied to a second input terminal of first AND gate 131-2 and a first input terminal of second AND gate 131-3. Also, an output signal of first inverter 131-1 is applied to a first input terminal of first AND gate 131-2. Accordingly, first AND gate 131-2 outputs first charge control signal CTL_ch having a logic state '1' where a logic state of second control signal CTL2 is '0' and a logic state of first control signal CTL1 is '1', and outputs first control signal CTL_ch having a logic state '0' in other cases.

Second inverter 131-4 inverts the first charge control signal CLT_ch, and applies the inverted first charge control signal CTL_ch to a first input terminal of third AND gate 131-6. First detection signal DET1 is applied to a second input terminal of third AND gate 131-6.

Third inverter 131-5 inverts first discharge control signal CTL_dis and outputs the inverted first discharge control signal CTL_dis to a first input terminal of fourth AND gate 131-7. Second detection signal DET2 is applied to a second input terminal of fourth AND gate 131-6.

In addition, an output signal of third AND gate 131-6 and first charge control signal CTL_ch are applied to first and second input terminals of first OR gate 131-8, and an output signal of fourth AND gate 131-7 and first discharge control signal CTL_dis are applied to first and second input terminals of second OR gate 131-9.

Second charge control signal CTL_ch(s) is output from first OR gate 131-8, and first discharge control signal CTL_dis(s) is output from second OR gate 131-9.

Where first control signal CTL1 is generated at the same timing as that in E of FIG. 18, second control signal CTL1 is generated at the same timing as that in F of FIG. 18, first detection signal DET1 is generated at the same timing as that in I of FIG. 18, and second detection signal DET2 is generated at the same timing as that in J of FIG. 18, first charge control signal CTL_ch and first discharge control signal CTL_dis are respectively generated as shown in H and G of FIG. 18. Also, second charge control signal CTL_ch(s) and second discharge control signal CTL_dis(s) are respectively generated as shown in K and L of FIG. 18.

Referring to FIG. 18, second charge control signal CTL_ch(s) controls charge pump 132A to form an additional sub-charge loop during a period T1 compared to first charge control signal CTL_ch. Also, second discharge control signal CTL_dis(s) controls charge pump 132A to form an additional sub-discharge loop during a period T2 compared to first discharge control signal CTL_dis.

Where second charge control signal CTL_ch(s) having a logic state '1' is applied from pre-processing unit 131B to first switch SW1, first switch SW1 forms a charge loop in charge pump 132A. Once the charge loop is formed, source current source Io is turned on and sync current source Id is turned off. Accordingly, current output from source current source Io is supplied to capacitors C1 and C2. As capacitors C1 and C2 are charged, output control voltage Vo generated in charge pump 132A is increased. Output control voltage Vo generated in charge pump 132A is increased in proportion to a length of a period where the charge loop is formed. The length of the period for which the charge loop is formed is determined by a length of a period where the logic state of second charge control signal CTL_ch(s) is maintained at '1'.

Where second discharge control signal CTL_dis(s) having a logic state '1' is applied from pre-processing unit 131B to first switch SW1, first switch SW1 forms a discharge loop in charge pump 132A. Once the discharge loop is formed, sync current source Id is turned on and source current source Io is turned off. Accordingly, a voltage of capacitors C1 and C2 is discharged through a ground terminal That is, discharge current flows through sync current source Id to the ground terminal. Accordingly, as the voltage of capacitors C1 and C2 is discharged, output control voltage Vo generated in charge pump 132A is reduced. Output control voltage Vo generated in charge pump 132A is reduced in proportion to a length of a period where the discharge loop is formed. The length of the period for which the discharge loop is formed is determined by a length of a period where the logic state of second discharge control signal CTL_dis(s) is maintained at '1'.

During a period where both second charge control signal CTL_ch(s) and second discharge control signal CTL_dis(s) are maintained at a logic state '0', both the charge loop and the discharge loop of charge pump 132A are opened. Where leakage current is disregarded during a period where both the charge loop and the discharge loop are opened, output control voltage Vo generated in charge pump 132A is not changed.

Figure 16:
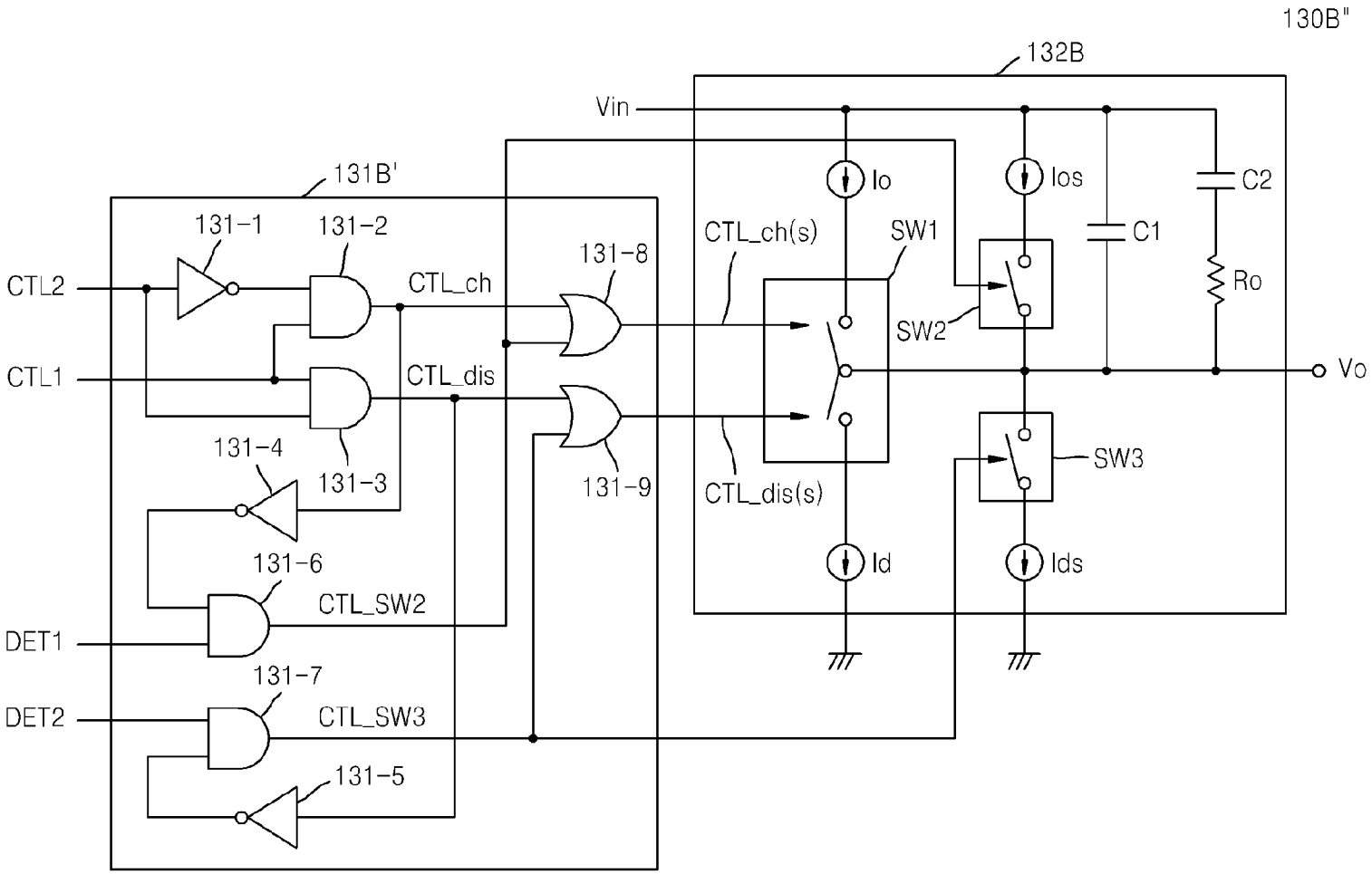
FIG. 16 is a block diagram illustrating a detailed structure of a charge pump circuit of FIGS. 1A through 1D, according to another embodiment of the inventive concept.

FIG. 16 is a block diagram illustrating a detailed structure of a charge pump circuit 130B" of FIGS. 1A through 1D, according to another embodiment of the inventive concept.

Referring to FIG. 16, charge pump circuit 130B" comprises a pre-processing unit 131B' and a charge pump 132B.

Pre-processing unit 131B' generates second charge control signal CTL_ch(s), second discharge control signal CTL_dis(s), a second switch control signal CTL_SW2, and a third switch control signal CTL_SW3 for switching a charge or discharge operation of charge pump 132B by using first control signal CTL1 and second control signal CTL2, which are input from phase synthesizing unit 120, and first detection signal DET1 and second detection signal DET2, which are input from window level detection unit 170. For example, pre-processing unit 131B' comprises first through third inverters 131-1, 131-4, and 131-5, first through fourth AND gates 131-2, 131-3, 131-6, and 131-7, and first and second OR gates 131-8 and 131-9.

Second control signal CTL2 is applied to an input terminal of first inverter 131-1 and a second input terminal of second AND gate 131-3. First control signal CTL1 is applied to a second input terminal of first AND gate 131-2 and a first input terminal of second AND gate 131-3. Also, an output signal of inverter 131-1 is applied to a first input terminal of first AND gate 131-2.

First AND gate 131-2 outputs first charge control signal CTL_ch having a logic state '1' where a logic state of second control signal CTL2 is '0' and a logic state of first control signal CTL1 is '1', and outputs first charge control signal CTL_ch having a logic state '0' in other cases.

Second inverter 131-4 inverts first charge control signal CTL_ch and applies the inverted first charge control signal CTL_ch to a first input terminal of third AND gate 131-6. First detection signal DET1 is applied to a second input terminal of third AND gate 131-6.

Second switch control signal CTL_SW2 is generated at an output terminal of third AND gate 131-6, and second switch control signal CTL_SW2 is applied to a second switch SW2 of charge pump 132B.

Third inverter 131-5 inverts first discharge control signal CTL_dis and applies the inverted first discharge control signal CTL_dis to a first input terminal of fourth AND gate 131-7. Second detection signal DET2 is applied to a second input terminal of fourth AND gate 131-6.

Third switch control signal CTL_SW3 is generated at an output terminal of fourth AND gate 131-6, and third switch control signal CTL_SW3 is applied to a third switch SW3 of charge pump 132B. Also, first charge control signal CTL_ch and an output signal of third And gate 131-6 are applied to first and second input terminals of first OR gate 131-8, and first discharge control signal CTL_dis and an output signal of fourth AND gate 131-7 are applied to first and second terminals of second OR gate 131-9.

Second charge control signal CTL_ch(s) is output from first OR gate 131-8, and first discharge control signal CTL_dis(s) is output from second OR gate 131-9.

Where first control signal CTL1 is generated at the same timing as that in E of FIG. 18, second control signal CTL1 is generated at the same timing as that in F of FIG. 18, first detection signal DET1 is generated at the same timing as that in I of FIG. 18, and second detection signal DET2 is generated at the same timing as that in J of FIG. 18, first charge control signal CTL_ch and first discharge control signal CTL_dis are respectively generated as shown in H and G of FIG. 18. Also, second charge control signal CTL_ch(s) and second discharge control signal CTL_dis(s) are generated as shown in K and L of FIG. 18, and second switch control signal CTL_SW2 and third switch control signal CTL_SW3 are respectively generated as shown in M and N of FIG. 18.

Charge pump 132B comprises the first and second switches SW1 and SW2, first and second source current sources Io and Ios, first and second sync current sources Id and Ids, capacitors C1 and C2, and resistor Ro. Vin denotes an input voltage that is a power voltage that is applied to any of LDO regulators 100A through 100D.

First source current source Io and first sync current source Id are controlled by first switch SW1, second source current source Ios is controlled by second switch SW2, and second sync current source Ids is controlled by third switch SW3.

Where second charge control signal CTL_ch(s) having a logic state '1' is applied from pre-processing unit 131B' to first switch SW1, first switch SW1 forms a charge loop by using first source current source Io in charge pump 132B. That is, current output from first source current source Io is supplied to capacitors C1 and C2 by turning on first source current source Io and turning off first sync current source Id. Accordingly, as capacitors C1 and C2 are charged, output control voltage Vo generated in charge pump 132B is increased.

Where second switch control signal CTL_SW2 having a logic state '1' is applied from pre-processing unit 1321B' to second switch SW2, second switch SW2 forms an additional sub-charge loop by using second source current source Ios in charge pump 132B. That is, current output from second source current source Ios is additionally supplied to capacitors C1 and C2 by turning on second source current source Ios. Accordingly, as additional charge current is supplied by second source current source Ios to capacitors C1 and C2, output control voltage Vo generated in charge pump 132B may be rapidly increased.

Where second discharge control signal CTL_dis(s) having a logic state '1' is applied from pre-processing unit 131B' to first switch SW1, first switch SW1 forms a discharge loop in charge pump 132B. Once the discharge loop is formed, first sync current source Id is turned on and first source current source Io is turned off. Accordingly, a voltage of capacitors C1 and C2 is discharged through a ground terminal. That is, discharge current flows through first sync current source Id to the ground terminal. Accordingly, as the voltage of capacitors C1 and C2 is discharged, output control voltage Vo generated in charge pump 132B is reduced.

Also, where third switch control signal CTL_SW3 having a logic state '1' is applied from pre-processing unit 131B' to third switch SW3, third switch SW3 forms an additional sub-discharge loop by using second sync current source Ids in charge pump 132B. That is, additional discharge current flows through second sync current source Ids to the ground terminal. Accordingly, as the voltage of capacitors C1 and C2 is additionally discharged, output control voltage Vo generated in charge pump 132B may be rapidly reduced.

Figure 17:
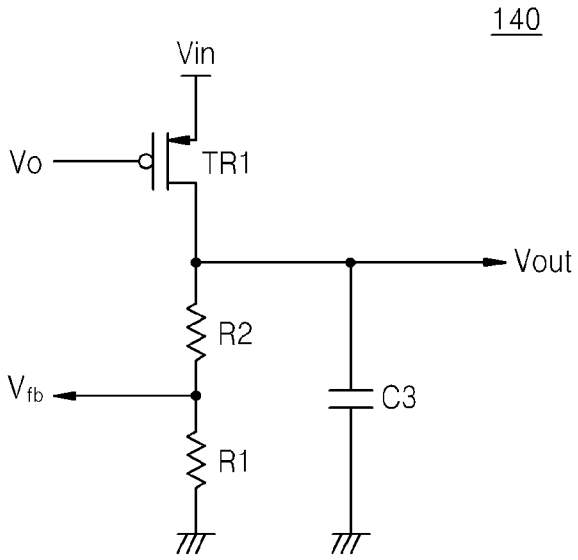
FIG. 17 is a diagram illustrating a detailed structure of an output circuit of FIGS. 1A through 1D, according to an embodiment of the inventive concept.

FIG. 17 is a diagram illustrating a detailed structure of output circuit 140 of FIGS. 1A through 1D, according to an embodiment of the inventive concept.

Referring to FIG. 17, output circuit 140 comprises a PMOS transistor TR1, first and second resistors R1 and R2, and a capacitor C3.

Output control voltage Vo generated in charge pump circuit 130 is applied to a gate terminal of PMOS transistor TR1, input voltage Vin is applied to a first terminal, and first and second resistors R1 and R2 are disposed between a second terminal and a ground terminal and are connected in series. Also, capacitor C3 is disposed between the second terminal and the ground terminal and is connected in parallel to first and second resistors R1 and R2.

Output voltage Vout of the LDO regulator is output from the second terminal of PMOS transistor TR1, and analog feedback voltage signal $V_{fb}$ is output from a node at which first resistor R1 and second resistor R2 are connected. First resistor R1 and second resistor R2 correspond to a voltage divider circuit.

PMOS transistor TR1 controls output voltage Vout of the LDO regulator by bypassing or cutting off input voltage Vin, which is applied to a source terminal, to a drain terminal that is an output terminal according to output control voltage Vo that is applied to the gate terminal.

Where output control voltage Vo is reduced based on analog feedback voltage signal $V_{fb}$ and thus PMOS transistor TR1 is turned on, output voltage Vout of the LDO regulator is increased. In contrast, where output voltage Vo is increased based on analog feedback voltage signal $V_{fb}$ and thus PMOS transistor TR1 is turned off, output voltage Vout of the LDO regulator is reduced.

Figure 19:
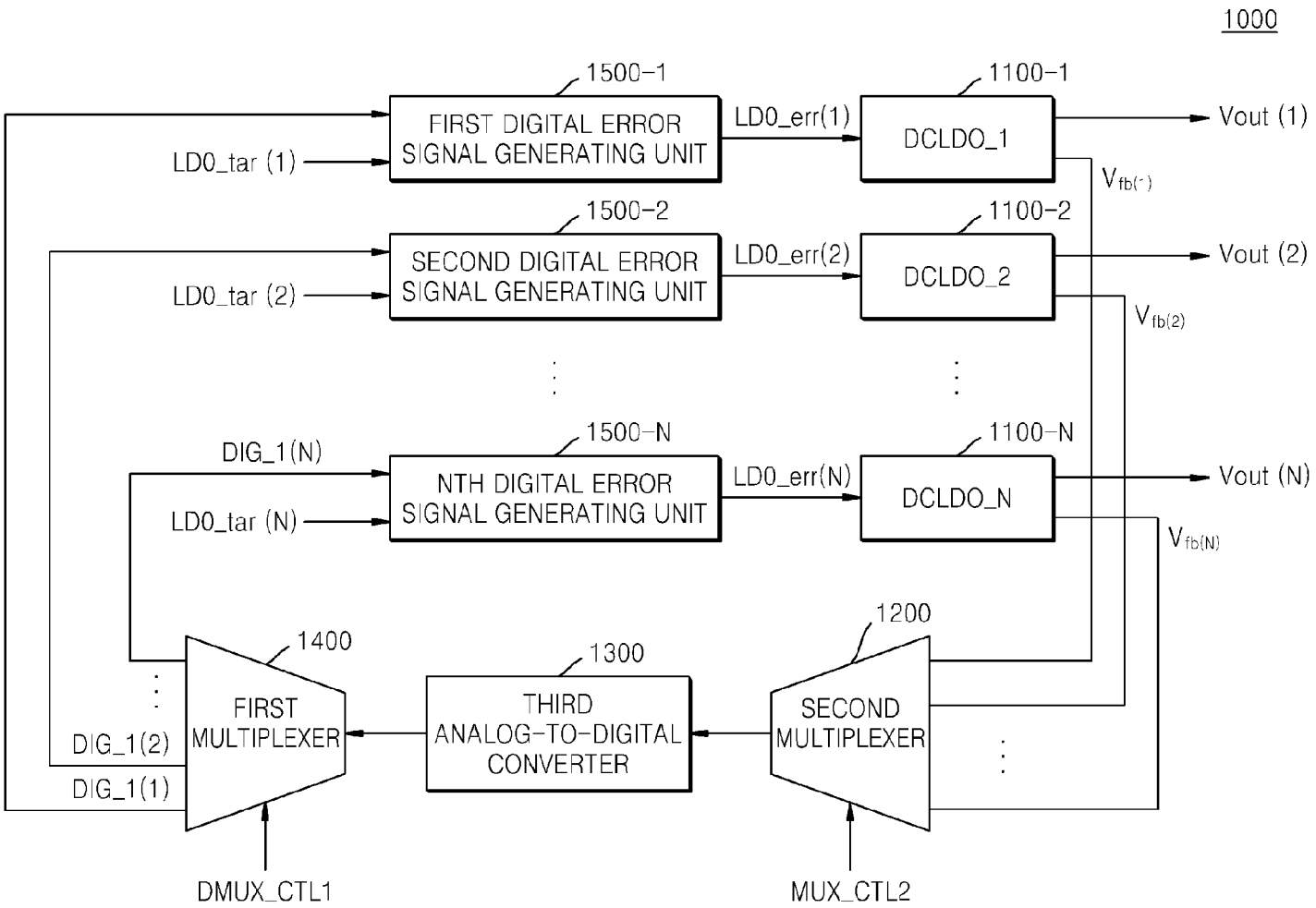
FIG. 19 is a block diagram illustrating a power management system, according to an embodiment of the inventive concept.

FIG. 19 is a block diagram illustrating a power management system 1000 according to an embodiment of the inventive concept.

Referring to FIG. 19, power management system 1000 comprises digitally controlled LDO apparatuses DCLDO_1 through DCLDO_N 1100-1 through 1100-N, a second multiplexer 1200, a third ADC 1300, a first demultiplexer 1400, and digital error signal generating units 1500-1 through 1500-N.

Each of the digitally controlled LDO apparatuses DCLDO_1 through DCLDO_N 1100-1 through 1100-N is an apparatus comprising phase synthesizing unit 120, charge pump 130, and output circuit 140 from among circuits of any of the LDO regulators of FIGS. 1A through 1D. That is, each of the digitally controlled LDO apparatuses DCLDO_1 through DCLDO_N 1100-1 through 1100-N generates an LDO output voltage Vout(i) and a feedback analog voltage signal $V_{fb(i)}$ by performing phase synthesis on signals that are generated according to a delay by one clock cycle and a skew delay within a clock cycle based on a second digital signal LDO_err(i) according to a channel.

Feedback analog voltage signals $V_{fb(i)}$ through $V_{fb(N)}$ for multiple LDO regulators are input in parallel to second multiplexer 1200. Second multiplexer 1200 multiplexes and outputs feedback analog voltage signals $V_{fb(i)}$ through $V_{fb)(N)}$ for the LDO regulators based on time division by using a second multiplexer control signal MUX_CTL2.

Third ADC 1300 sequentially converts feedback analog voltage signals $V_{fb(i)}$ through $V_{fb(N)}$ output from second multiplexer 1200 into first digital signals DIG_1 and outputs first digital signals DIG_1.

First demultiplexer 1400 distributes and outputs first digital signals DIG_1(*i*) according to channels that are sequentially obtained by third ADC 1300 to corresponding channels by using a first demultiplexer control signal DMUX_CTL1.

Each of the digital error signal generating units 1500-1 through 1500-N outputs a second digital signal LDO_err(i) corresponding to a difference between a target digital signal LDO_tar(i) and first digital signal DIG_1(*i*) input to a corresponding channel.

Each of the digital error signal generating units 1500-1 through 1500-N may be realized as subtraction circuit 110-2A of FIG. 2 or digital filter 110-2B of FIG. 3.

Referring to FIG. 19, N LDO regulators for regulating an output voltage under digital control may be designed by commonly using one ADC.

Figure 20:
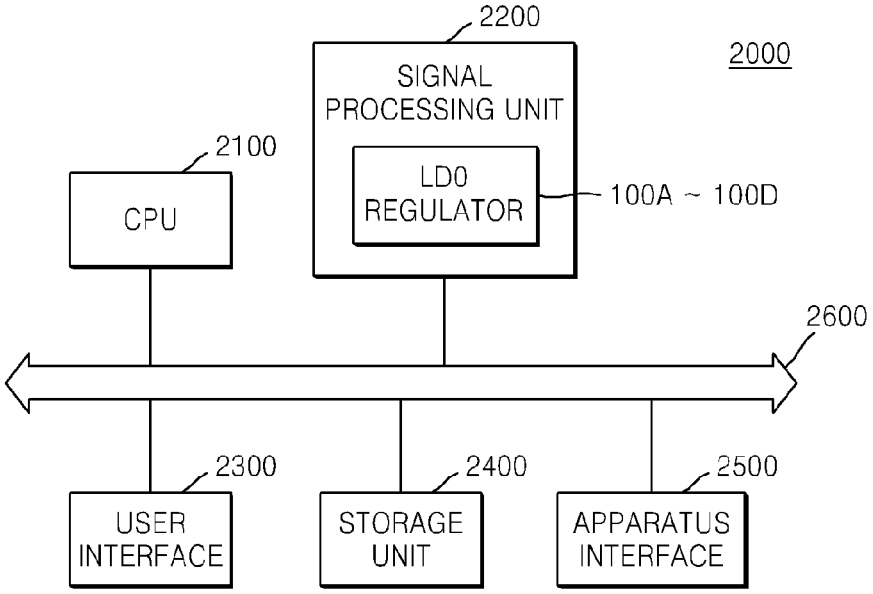
FIG. 20 is a block diagram illustrating an electronic apparatus comprising an LDO regulator, according to an embodiment of the inventive concept.

FIG. 20 is a block diagram illustrating an electronic apparatus 2000 comprising an LDO regulator, according to an embodiment of the inventive concept.

Referring to FIG. 20, electronic apparatus 2000 comprises a central processing unit (CPU) 2100, a signal processing unit 2200, a user interface 2300, a storage unit 2400, an apparatus interface 2500, and a bus 2600.

Examples of electronic apparatus 2000 include, among others, a computer, a mobile phone, a personal digital assistant (PDA), a portable digital assistant (PMP), an MP3 player, a camera, a camcorder, a TV set, or a display device.

CPU 2100 controls an overall operation of electronic apparatus 2000. For example, CPU 2100 may control elements of electronic apparatus 2000 based on information that is input through user interface 2300.

Signal processing unit 2200 processes a signal that is received through apparatus interface 2500 or a signal that is read from storage unit 2400 according to a specified standard. For example, signal processing unit 2200 may process a video signal or an audio signal. Examples of signal processing unit 2200 include any of LDO regulators 100A through 100D. For example, any of LDO regulators 100A through 100D may be used to process a video signal, an audio signal, or a power voltage signal in electronic apparatus 2000.

User interface 2300 is an input apparatus by using which a function of electronic apparatus 2000 is set or a user sets information necessary to operate electronic apparatus 2000.

Storage unit 2400 stores various pieces of information necessary to operate electronic apparatus 2000. Also, storage unit 2400 may store data that is received through apparatus interface 2500 or data that is processed by electronic apparatus 2000. Apparatus interface 2500 transmits/receives data to/from an external apparatus that is connected in a wired or wireless manner to electronic apparatus 2000. Bus 2600 functions to transmit information between elements of electronic apparatus 2000.

Figure 21:
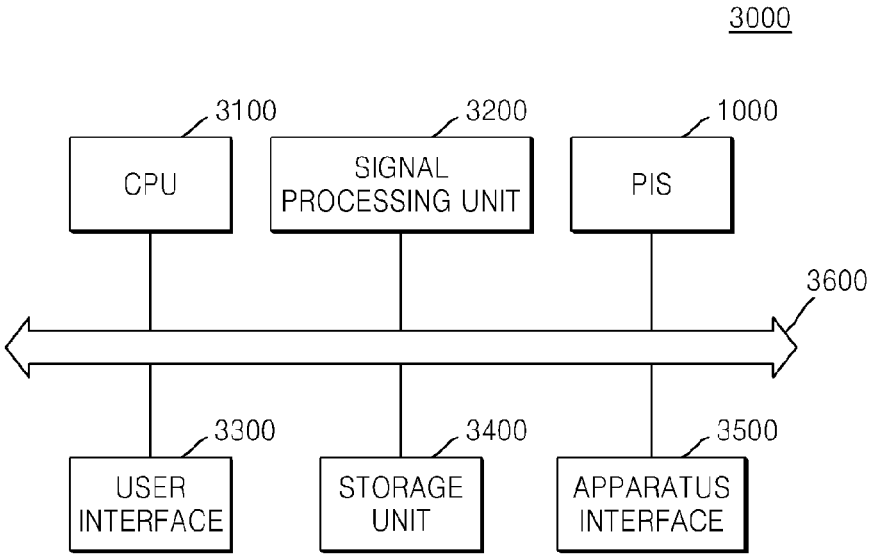
FIG. 21 is a block diagram illustrating an electronic apparatus comprising a power management system, according to an embodiment of the inventive concept.

FIG. 21 is a block diagram illustrating an electronic apparatus 3000 comprising a power management system PIS 1000, according to an embodiment of the inventive concept.

Referring to FIG. 21, electronic apparatus 3000 comprises power management system PIS; 1000, a CPU 3100, a signal processing unit 3200, a user interface 3300, a storage unit 3400, an apparatus interface 3500, and a bus 3600.

Examples of electronic apparatus 3000 include, among others, a computer, a mobile phone, a PDA, a PMP, an MP3 player, a camera, a camcorder, a TV set, and a display device.

Power management system PIS 1000 may be power management system 1000 of FIG. 19. Power management system PIS 1000 may be an integrated circuit. Output voltages of multiple LDO regulators that are generated in power management system PIS 1000 may be applied to elements constituting electronic apparatus 3000.

CPU 3100 may control overall operation of electronic apparatus 3000. For example, CPU 3100 may control elements of electronic apparatus 3000 based on information that is input through user interface 3300.

Signal processing unit 3200 processes a signal that is received through apparatus interface 3500 or a signal that is read from storage unit 3400 according to a given standard. For example, signal processing unit 3200 may process a video signal or an audio signal.

User interface 3300 is an input apparatus by using which a function of electronic apparatus 3000 is set or a user sets information necessary to operate electronic apparatus 3000.

Storage unit 3400 stores various units of information that used to operate electronic apparatus 3000. Also, storage unit 3400 may store data that is received through apparatus interface 3500 or data that is processed by electronic apparatus 3000.

Apparatus interface 3500 transmits/receives data to/from an external apparatus that is connected in a wired or wireless manner to electronic apparatus 3000.

Bus 3600 functions to transmit information between elements of electronic apparatus 3000.

Figure 22:
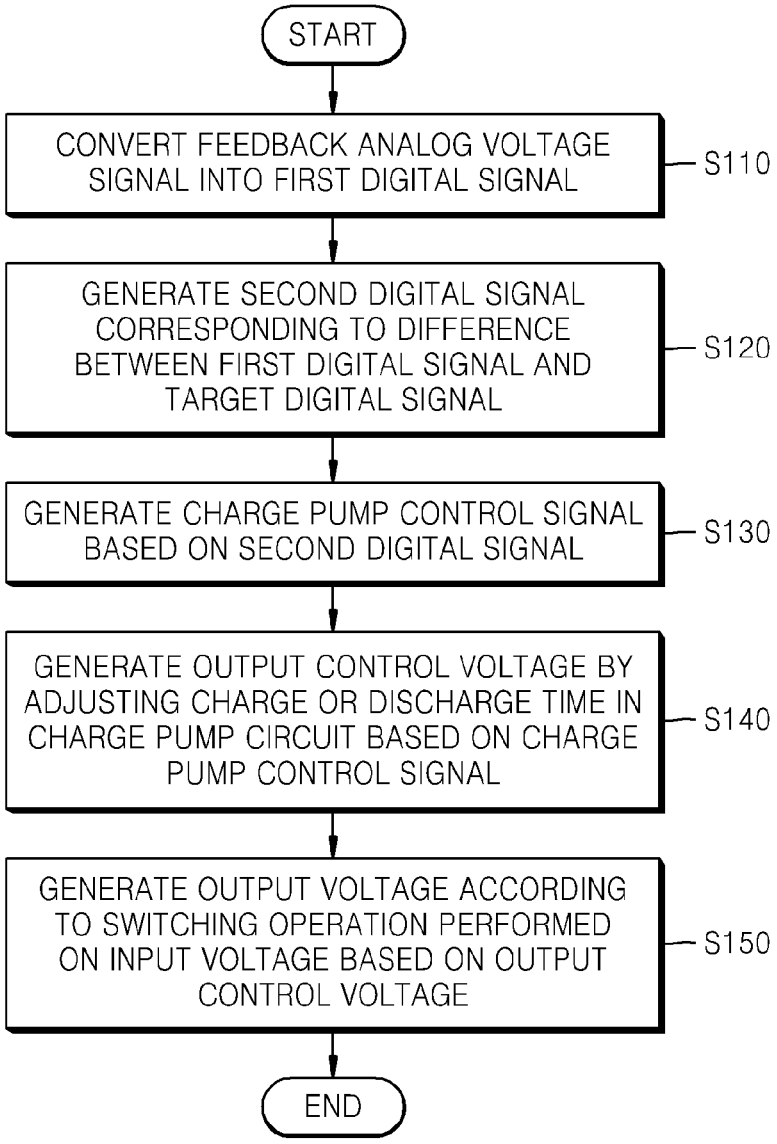
FIG. 22 is a flowchart illustrating a method of controlling an LDO voltage, according to an embodiment of the inventive concept.

FIG. 22 is a flowchart illustrating a method of controlling an LDO voltage, according to an embodiment of the inventive concept. For convenience, this method will be described with reference to electronic apparatus 2000 or 3000 of FIG. 20 or 21.

Referring to FIG. 22, in operation 5110, electronic apparatus 2000 or 3000 performs signal processing by converting feedback analog voltage signal $V_{fb}$ into a first digital signal by using an ADC of an LDO regulator. Feedback analog voltage signal $V_{fb}$ is a signal that is fed back from an output circuit of the LDO regulator.

In operation S120, electronic apparatus 2000 or 3000 generates second digital signal LDO_err corresponding to a difference between the first digital signal and target digital signal LDO_tar. Second digital signal LDO_err refers to a digital error signal. For example, second digital signal LDO_err comprises a bit indicating polarity information, and bits indicating error information. In detail, the polarity information may be indicated by using a most significant bit of second digital signal LDO_err and the error information may be indicated by using bits other than the most significant bit.

In operation S130, electronic apparatus 2000 or 3000 generates a charge pump control signal by performing phase synthesis on signals that are generated according to delay control by one clock cycle and skew control within a clock cycle based on second digital signal LDO_err. For example, the charge pump control signal may include second control signal CTL2 having a logic state corresponding to the polarity information in second digital signal LDO_err and first control signal CTL1 having a pulse width corresponding to the error information in second digital signal LDO_err.

In operation S140, electronic apparatus 2000 or 3000 generates output control voltage Vo by adjusting a charge or discharge time in a charge pump circuit based on the charge pump control signal. Electronic apparatus 2000 selects a charge loop or a discharge loop of the charge pump circuit based on the logic state of second control signal CTL2, and makes current flow during a period corresponding to the pulse width of first control signal CTL1 in the selected loop. Due to this operation, output control voltage Vo is generated in the charge pump circuit.

In operation S150, electronic apparatus 2000 or 3000 generates output voltage Vout according to a switching operation performed on an input voltage based on output control voltage Vo. For reference, feedback analog voltage signal $V_{fb}$ is generated based on output voltage Vout.

Figure 23:
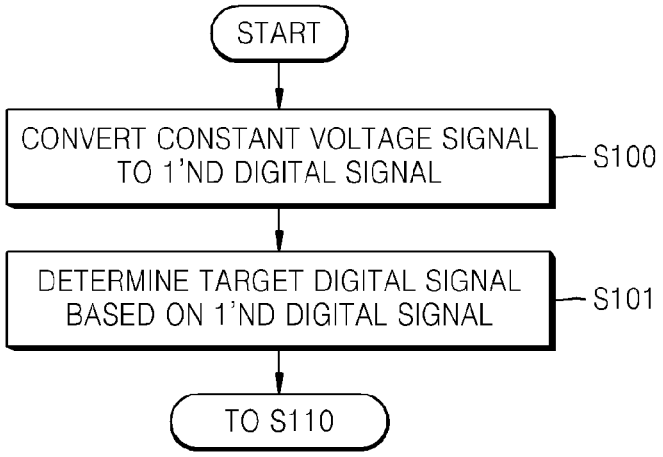
FIG. 23 is a flowchart illustrating a method of determining a target digital signal in a method of controlling an LDO voltage, according to an embodiment of the inventive concept.

FIG. 23 is a flowchart illustrating a method of determining a target digital signal in a method of controlling an LDO voltage, according to an embodiment of the inventive concept. For convenience, the method will be described with reference to electronic apparatus 2000 or 3000.

Referring to FIG. 23, in operation 5100, electronic apparatus 2000 or 3000 converts constant voltage signal $V_{ref}$ into a 1'nd digital signal by using an ADC of an LDO regulator. For example, constant voltage signal $V_{ref}$ may be a constant voltage output from a band-gap reference voltage generating circuit.

In operation 5101, electronic apparatus 2000 or 3000 determines a target digital signal as a result obtained by multiplying a result obtained by performing an averaging operation on the 1'nd digital signal by a preset gain value.

Because the target digital signal is determined due to this operation, an offset in the ADC used in the LDO regulator may be reduced.

Figure 24:
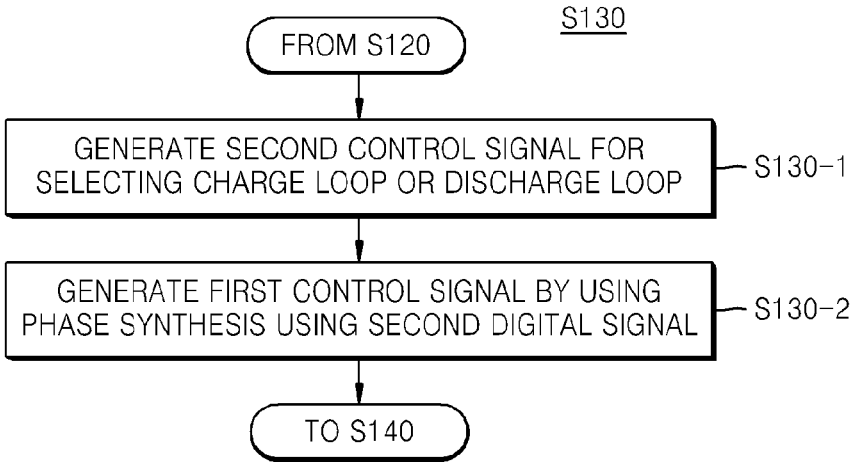
FIG. 24 is a detailed flowchart illustrating an operation of generating a charge pump control signal in the method of FIG. 22, according to an embodiment of the inventive concept.

FIG. 24 is a detailed flowchart illustrating operation S130 in which a charge pump control signal is generated in the method of FIG. 22, according to an embodiment of the inventive concept.

Referring to FIG. 24, in operation S130-1, electronic apparatus 2000 or 3000 generates second control signal CTL2 for selecting a charge loop or a discharge loop of a charge pump circuit based on polarity bit information in second digital signal LDO_err. For example, second control signal CTL2 may be generated as an output of a most significant bit indicating the polarity information of second digital signal LDO_err.

In operation S130-2, electronic apparatus 2000 or 3000 generates first control signal CTL1 by using phase synthesis using second digital signal LDO_err. For example, electronic apparatus 2000 or 3000 may generate first control signal CTL1 by performing phase synthesis on signals that are generated according to delay control by one clock cycle based on a value of bits of a first part constituting second digital signal LDO_err and skew control within a clock cycle based on a value of bits of a second part constituting second digital signal LDO_err. In detail, electronic apparatus 2000 or 3000 generates first control signal CTL1 having a pulse width corresponding to the error information in second digital signal LDO_err.

Figure 25:
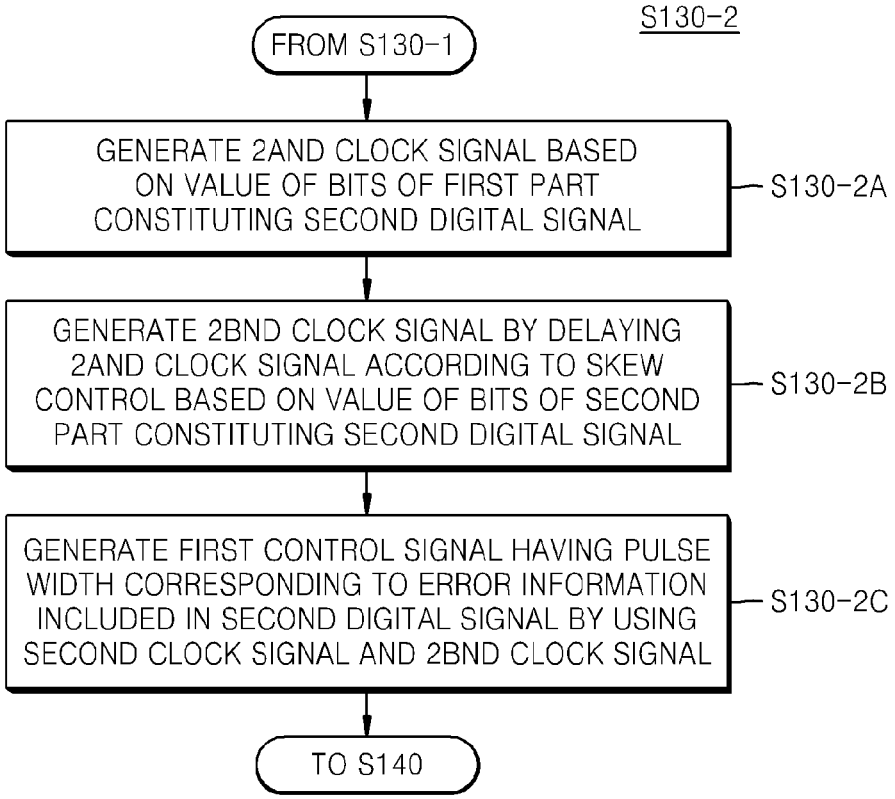
FIG. 25 is a detailed flowchart illustrating an operation of generating a first control signal in the operation of FIG. 24, according to an embodiment of the inventive concept.

FIG. 25 is a detailed flowchart illustrating operation S130-2 in which first control signal CTL1 is generated in operation S130 of FIG. 24, according to an embodiment of the inventive concept.

Referring to FIG. 25, in operation S130-2A, electronic apparatus 2000 or 3000 generates the 2And clock signal CLK2-d1 by delaying second clock signal CLK2 based on the value of the bits of the first part constituting second digital signal LDO_err. For example, electronic apparatus 2000 or 3000 generates the 2And clock signal CLK2_d1 by delaying second clock signal CLK2 by one cycle of first clock signal CLK1 based on the value of the bits of the first part constituting second digital signal LDO_err. Second clock signal CLK2 is a signal whose pulse is generated at every preset integer multiple of first clock signal CLK1 which is equal to or greater than 2.

In operation S130-2B, electronic apparatus 2000 or 3000 generates the 2Bnd clock signal CLK2_d2 by delaying the 2And clock signal CLK2_d1 according to skew control based on the value of the bits of the second part constituting second digital signal LDO_err. Electronic apparatus 2000 or 3000 may output the 2Bnd clock signal CLK2_d2 obtained by delaying the 2And clock signal CLK2_d1 by a preset resolution time according to skew control based on the value of the bits of the second part constituting second digital signal LDO_err. The resolution time that is set as an initial value may be determined as a time obtained by dividing one cycle of first clock signal CLK1 by $2^K$. Alternatively, the resolution time that is set as an initial value may be determined to be less or greater by a predetermined amount than the time obtained by dividing the one cycle of the first clock signal by $2^K$.

In operation S130-2C, electronic apparatus 2000 or 3000 generates first control signal CTL1 having a pulse width corresponding to the error information in the second digital signal by synthesizing phases of second clock signal CLK2 and the 2Bnd clock signal CLK2_d2. For example, the error information may be indicated by using the bits of the first part and the bits of the second part constituting second digital signal LDO_err. For example, electronic apparatus 2000 or 3000 may generate first control signal CTL1 having a pulse width from a point of time where a pulse of second clock signal CLK2 is generated to a point of time where a pulse of the 2Bnd clock signal CLK2_d2 is generated.

The foregoing is illustrative of embodiments and is not to be construed as limiting thereof. Although a few embodiments have been described, those skilled in the art will readily appreciate that many modifications are possible in the embodiments without materially departing from the scope of the inventive concept. Accordingly, all such modifications are intended to be included within the scope of the inventive concept as defined in the claims.

What is claimed is:

1. A low-dropout (LDO) regulator comprising:

an analog-to-digital converter (ADC) that converts a feedback analog voltage signal into a first digital signal, and generates a second digital signal corresponding to a difference between the first digital signal and a target digital signal;

a phase synthesizing unit that generates a first control signal having a pulse width corresponding to error information in the second digital signal by performing phase synthesis on signals generated according to a skew delay within a clock cycle and a delay by one clock cycle based on the second digital signal;

a charge pump circuit that selects a charge loop or a discharge loop based on polarity information in the second digital signal, and generates an output control voltage according to current that flows during a period corresponding to the pulse width of the first control signal in the selected loop; and an output circuit that generates an output voltage according to a switching operation performed on an input voltage based on the output control voltage, and generates the feedback analog voltage signal from the output voltage.

2. The LDO regulator of claim 1, wherein the phase synthesizing unit adjusts the pulse width of the first control signal according to clock skew control based on bits indicating part of the error information in the second digital signal.

3. The LDO regulator of claim 1, wherein the ADC comprises:

a first ADC that converts the feedback analog voltage signal into a digital signal of N (N>1) bits; and a subtraction circuit that generates the second digital signal with N bits corresponding to a difference between the digital signal of N bits and the target digital signal.

4. The LDO regulator of claim 2, wherein the ADC comprises:

a first ADC that converts the feedback analog voltage signal into a digital signal of M (M>1) bits; and a digital filter that receives the digital signal of M bits and generates the second digital signal with N bits (N>M) based on average filtering and subtraction performed on the target digital signal.

5. The LDO regulator of claim 4, wherein the digital filter comprises:

a first multiplier that outputs a first operation signal of N bits obtained by multiplying the digital signal of M bits by a first coefficient;

an adder that outputs a second operation signal of N bits obtained by adding the first operation signal to a third operation signal;

a delayer that delays the second operation signal by a sampling time and outputs the delayed second operation signal;

a second multiplier that outputs to the adder the third operation signal of N bits obtained by multiplying a signal output from the delayer by a second coefficient;

a subtractor that outputs a fourth operation signal of N bits obtained by subtracting the second operation signal from the target digital signal;

a third multiplier that outputs a fifth operation signal of N bits obtained by multiplying the fourth operation signal by a third coefficient; and a barrel shifter that outputs the second digital signal obtained by shifting the fifth operation signal by at least one bit to the right, wherein each of the first coefficient, the second coefficient, and the third coefficient is greater than 0 and less than 1.

6. The LDO regulator of claim 1, wherein the phase synthesizing unit further generates a second control signal corresponding to the polarity information in the second digital signal, wherein the charge loop or the discharge loop of the charge pump circuit is selected based on the second control signal.

7. The LDO regulator of claim 1, wherein the phase synthesizing unit comprises:

a first frequency divider that generates a second clock signal comprising pulses generated at preset integer multiples of a first clock signal which is equal to or greater than 2;

a first delay circuit that generates a third clock signal by delaying the first clock signal by one cycle of the first clock signal based on a value of bits of a first part of the second digital signal;

a second delay circuit that generates a fourth clock signal by delaying the third clock signal by a preset resolution time according to clock skew control based on a value of bits of a second part constituting the second digital signal; and a first logic circuit that generates the first control signal having the pulse width corresponding to a sum of delay values in the first delay circuit and the second delay circuit based on the second clock signal and the fourth clock signal.

8. The LDO regulator of claim 1, wherein the charge pump circuit comprises:

a pre-processing unit that generates a charge control signal and a discharge control signal based on the first control signal and a second control signal; and a charge pump that forms the charge loop or the discharge loop based on the charge control signal and the discharge control signal and generates the output control voltage that is higher or lower than the input voltage.

9. The LDO regulator of claim 1, wherein the output circuit comprises:

a transistor that turns on or off electrical connection between a first terminal and a second terminal to which the input voltage is applied based on the output control voltage applied to a gate terminal;

a voltage divider circuit that is connected between the first terminal and a ground terminal and generates the feedback analog voltage signal; and a capacitor that is disposed between the first terminal and the ground terminal and is connected in parallel to the voltage divider circuit, wherein the output voltage is generated at the first terminal.

10. The LDO regulator of claim 1, further comprising a window level detection unit that generates a first detection signal having a first logic state during a period where an error value in the second digital signal is less than a lower threshold value, and generates a second detection signal having a first logic state during a period where the error value is the second digital signal is greater than an upper threshold value, wherein an additional sub-charge loop is formed in the charge pump circuit based on the first detection signal, and an additional sub-discharge loop is formed in the charge pump circuit based on the second detection signal.

11. The LDO regulator of claim 1, further comprising:

a multiplexer that receives the feedback analog voltage signal and a constant voltage signal, and outputs one of the feedback analog voltage signal and the constant voltage signal to the ADC according to a selection control signal; and a target digital signal generating unit that generates the target digital signal based on the first digital signal that is generated by the ADC during a period where the constant voltage signal is output to the multiplexer.

12. The LDO regulator of claim 11, wherein the target digital signal generating unit determines the target digital signal as a result obtained by multiplying a result obtained by performing averaging operation on the first digital signal by a preset gain value.

13. A power management system comprising:

a multiplexer that multiplexes feedback analog voltage signals for multiple low-dropout (LDO) regulators based on time division;

an analog-to-digital converter (ADC) that converts a signal output from the multiplexer into multiple first digital signals;

a demultiplexer that distributes the first digital signals to multiple channels based on time division;

digital error signal generating units corresponding to the channels and each generating a second digital signal corresponding to a difference between one of the first digital signals and a target digital signal in a corresponding one of the channels; and digitally controlled LDO apparatuses corresponding to the channels and each generating an analog output voltage and a feedback analog voltage signal by performing phase synthesis on signals that are generated according to a skew delay within a clock cycle and a delay by one clock cycle based on one of the second digital signals that is input through a corresponding one of the channels.

14. The power management system of claim 13, wherein each of the digitally controlled LDO apparatuses comprises:

a phase synthesizing unit that generates a first control signal having a pulse width corresponding to error information in a corresponding one of the second digital signals by performing the phase synthesis on the signals that are generated according to the skew delay within the clock cycle and the delay by the clock cycle based on the corresponding one of the second digital signals;

a charge pump circuit that selects a charge loop or a discharge loop based on a second control signal corresponding to polarity information in the corresponding one of the second digital signals, and generates an output control voltage according to current that flows during a period corresponding to the pulse width of the first control signal in the selected loop; and an output circuit that generates an output voltage according to a switching operation performed on an input voltage based on the output control voltage, and generates the feedback analog voltage signal from the output voltage.

15. A low-dropout (LDO) regulator comprising:

an analog-to-digital converter (ADC) that converts a feedback analog voltage signal into a digital signal;

a phase synthesizing unit that generates a first control signal having a pulse width corresponding to error information in the digital signal by performing phase synthesis according to clock skew control;

a charge pump circuit that selects a charge loop or a discharge loop based on polarity information in the digital signal, and generates an output control voltage according to current that flows during a period corresponding to the pulse width of the first control signal in the selected loop; and an output circuit that generates an output voltage based on an input voltage and the output control voltage, and generates the feedback analog voltage signal based on the output voltage.

16. The LDO regulator of claim 15, wherein the phase synthesizing unit adjusts the pulse width of the first control signal according to clock skew control based on bits indicating part of the error information in the digital signal.

17. The LDO regulator of claim 15, wherein the phase synthesizing unit further generates a second control signal corresponding to the polarity information in the digital signal, and the charge loop or the discharge loop of the charge pump circuit is selected based on the second control signal.

18. The LDO regulator of claim 15, wherein the phase synthesizing unit comprises:

a first frequency divider that generates a second clock signal comprising pulses generated at preset integer multiples of a first clock signal;

a first delay circuit that generates a third clock signal by delaying the first clock signal by one cycle of the first clock signal based on a value of bits of a first part of the digital signal;

a second delay circuit that generates a fourth clock signal by delaying the third clock signal by a preset resolution time according to clock skew control based on a value of bits of a second part constituting the digital signal; and a first logic circuit that generates the first control signal having the pulse width corresponding to a sum of delay values in the first delay circuit and the second delay circuit based on the second clock signal and the fourth clock signal.

19. The LDO regulator of claim 15, wherein the ADC comprises:

a first ADC that converts the feedback analog voltage signal into a digital signal of N (N>1) bits; and a subtraction circuit that generates the second digital signal with N bits corresponding to a difference between the digital signal of N bits and the target digital signal.

* * * * *